US008026873B2

(12) United States Patent
Leon et al.

(10) Patent No.: US 8,026,873 B2
(45) Date of Patent: Sep. 27, 2011

(54) ELECTROLUMINESCENT DISPLAY COMPENSATED ANALOG TRANSISTOR DRIVE SIGNAL

(75) Inventors: Felipe A. Leon, Rochester, NY (US); Christopher J. White, Avon, NY (US); Gary Parrett, Rochester, NY (US); Bruno Primerano, Honeoye Falls, NY (US)

(73) Assignee: Global OLED Technology LLC, Herndon, VA (US)

( * ) Notice: Subject to any disclaimer, the term of this patent is extended or adjusted under 35 U.S.C. 154(b) by 717 days.

(21) Appl. No.: 11/962,182

(22) Filed: Dec. 21, 2007

(65) Prior Publication Data

US 2009/0160740 A1 Jun. 25, 2009

(51) Int. Cl.
*G09G 3/30* (2006.01)

(52) U.S. Cl. ..... 345/76; 315/169.3

(58) Field of Classification Search ..... 345/690, 345/36, 38, 39, 79; 315/169.3
See application file for complete search history.

(56) References Cited

U.S. PATENT DOCUMENTS

| | | | | |
|---|---|---|---|---|
| 4,896,947 | A | 1/1990 | Leenbouts | |
| 5,034,340 | A | 7/1991 | Tanaka et al. | |
| 6,489,631 | B2 | 12/2002 | Young et al. | |
| 6,518,962 | B2 * | 2/2003 | Kimura et al. | 345/211 |
| 6,995,519 | B2 * | 2/2006 | Arnold et al. | 315/169.3 |
| 7,116,058 | B2 | 10/2006 | Lo et al. | |
| 7,199,602 | B2 | 4/2007 | Nara et al. | |
| 7,834,825 | B2 * | 11/2010 | Mizukoshi et al. | 345/77 |
| 2003/0174152 | A1 * | 9/2003 | Noguchi | 345/690 |
| 2006/0007248 | A1 * | 1/2006 | Reddy et al. | 345/690 |
| 2006/0007249 | A1 * | 1/2006 | Reddy et al. | 345/690 |
| 2006/0158402 | A1 | 7/2006 | Nathan et al. | |
| 2006/0273997 | A1 * | 12/2006 | Nathan et al. | 345/78 |
| 2008/0048951 | A1 | 2/2008 | Naugler, Jr. et al. | |

FOREIGN PATENT DOCUMENTS

WO WO 2005/071649 A1 8/2005

OTHER PUBLICATIONS

PCT Notification Concerning Transmittal of International Preliminary Report on Patentability and Written opinion of the International Searching Authority dated Jul. 1, 2010.

Kagan & Andry, ed. *Thin-film Transistors*. New York: Marcel Dekker, 2003, Sec. 3.5, pp. 121-131. Shinar, ed. *Organic Light-Emitting Devices: a survey*. New York: Springer-Verlag, 2004. Sec.3.4, pp. 95-97.

Mohan et al., "Stability issues in digital circuits in amorphous silicon technology," Electrical and Computer Engineering, 2001, vol. 1, pp. 583-588.

Lee et al., in "A New a-Si:H TFT Pixel Design Compensating Threshold Voltage Degradation of TFT and OLED", SID 2004 Digest, pp. 264-274.

* cited by examiner

*Primary Examiner* — Amare Mengistu
*Assistant Examiner* — Vinh Lam
(74) *Attorney, Agent, or Firm* — Morgan, Lewis & Bockius LLP

(57) ABSTRACT

Apparatus for providing an analog drive transistor control signal to the gate electrode of a drive transistor in a drive circuit that applies current to an EL device, the drive circuit including a first supply electrode of the drive transistor and the EL device connected to a second supply electrode of the drive transistor, comprising a measuring circuit for measuring the current passing through the supply electrodes at different times to provide an aging signal representing variations in the characteristics of the drive transistor and EL device caused by operation of the drive transistor and EL device over time; a compensator for changing a linear code value in response to the aging signal to compensate for the variations in the characteristics of the drive transistor and EL device; and a linear source driver for producing the analog drive transistor control signal in response to the changed linear code value.

12 Claims, 14 Drawing Sheets

ELECTROLUMINESCENT DISPLAY COMPENSATED ANALOG TRANSISTOR DRIVE SIGNAL

CROSS REFERENCE TO RELATED APPLICATIONS

Reference is made to commonly-assigned, co-pending U.S. patent application Ser. No. 11/626,563 entitled "OLED Display with Aging and Efficiency Compensation" to Leon et al, dated Jan. 24, 2007, incorporated by reference herein.

FIELD OF THE INVENTION

The present invention relates to control of an analog signal applied to a drive transistor for supplying current through an electroluminescent device.

BACKGROUND OF THE INVENTION

Flat-panel displays are of great interest as information displays for computing, entertainment, and communications. Electroluminescent (EL) flat-panel display technologies, such as organic light-emitting diode (OLED) technology provides benefits in color gamut, luminance, and power consumption over other technologies such as liquid-crystal display (LCD) and plasma display panel (PDP). However, EL displays suffer from performance degradation over time. In order to provide a high-quality image over the life of the display, this degradation must be compensated for.

EL displays typically comprise an array of identical subpixels. Each subpixel comprises a drive transistor (typically thin-film, a TFT) and an EL device, the organic diode that actually emits light. The light output of an EL device is roughly proportional to the current through the device, so the drive transistor is typically configured as a voltage-controlled current source responsive to a gate-to-source voltage $V_{gs}$. Source drivers similar to those used in LCD displays provide the control voltages to the drive transistors. Source drivers convert a desired code value step 74 into an analog voltage step 75 to control a drive transistor. The relationship between code value and voltage is typically non-linear, although linear source drivers with higher bit depths are becoming available. Although the nonlinear code value-to-voltage relationship has a different shape for OLEDs than the characteristic LCD S-shape (shown in e.g. U.S. Pat. No. 4,896,947), the source driver electronics required are very similar between the two technologies. In addition to the similarity between LCD and EL source drivers, LCD displays and EL displays are typically manufactured on the same substrate: amorphous silicon (a-Si), as taught e.g. by Tanaka et al. in U.S. Pat. No. 5,034,340. Amorphous Si is inexpensive and easy to process into large displays.

Degradation Modes

Amorphous silicon, however, is metastable: over time, as voltage bias is applied to the gate of an a-Si TFT, its threshold voltage ($V_{th}$) shifts, thus shifting its I-V curve (Kagan & Andry, ed. *Thin-film Transistors*. New York: Marcel Dekker, 2003. Sec. 3.5, pp. 121-131). $V_{th}$ typically increases over time under forward bias, so over time, $V_{th}$ shift will, on average, cause a display to dim.

In addition to a-Si TFT instability, modern EL devices have their own instabilities. For example, in OLED devices, over time, as current passes through an OLED device, its forward voltage ($V_{oled}$) increases and its efficiency (typically measured in cd/A) decreases (Shinar, ed. *Organic Light-Emitting Devices: a survey*. New York: Springer-Verlag, 2004. Sec. 3.4, pp. 95-97). The loss of efficiency causes a display to dim on average over time, even when driven with a constant current. Additionally, in typical OLED display configurations, the OLED is attached to the source of the drive transistor. In this configuration, increases in $V_{oled}$ will increase the source voltage of the transistor, lowering $V_{gs}$ and thus, the current through the OLED device ($I_{oled}$), and therefore causing dimming over time.

These three effects ($V_{th}$ shift, OLED efficiency loss, and $V_{oled}$ rise) cause each individual OLED subpixel to lose luminance over time at a rate proportional to the current passing through that OLED device. ($V_{th}$ shift is the primary effect, $V_{oled}$ shift the secondary effect, and OLED efficiency loss the tertiary effect.) Therefore, as the display dims over time, those subpixels that are driven with more current will fade faster. This differential aging causes objectionable visible burn-in on displays. Differential aging is an increasing problem today as, for example, more and more broadcasters continuously superimpose their logos over their content in a fixed location. Typically, a logo is brighter than content around it, so the pixels in the logo age faster than the surrounding content, making a negative copy of the logo visible when watching content not containing the logo. Since logos typically contain high-spatial-frequency content (e.g. the AT&T globe), one subpixel can be heavily aged while an adjacent subpixel is only lightly aged. Therefore, each subpixel must be independently compensated for aging to eliminate objectionable visible burn-in.

Prior Art

It has been known to compensate for one or more of these three effects. Considering $V_{th}$ shift, the primary effect and one which is reversible with applied bias (Mohan et al., "Stability issues in digital circuits in amorphous silicon technology," Electrical and Computer Engineering, 2001, Vol. 1, pp. 583-588), compensation schemes are generally divided into four groups: in-pixel compensation, in-pixel measurement, in-panel measurement, and reverse bias.

In-pixel $V_{th}$ compensation schemes add additional circuitry to each subpixel to compensate for the $V_{th}$ shift as it happens. For example, Lee et al., in "A New a-Si:H TFT Pixel Design Compensating Threshold Voltage Degradation of TFT and OLED", SID 2004 Digest, pp. 264-274, teach a seven-transistor, one-capacitor (7T1C) subpixel circuit which compensates for $V_{th}$ shift by storing the $V_{th}$ of each subpixel on that subpixel's storage capacitor before applying the desired data voltage. Methods such as this compensate for $V_{th}$ shift, but they cannot compensate for $V_{oled}$ rise or OLED efficiency loss. These methods require increased subpixel complexity and increased subpixel electronics size compared to the conventional 2T1C voltage-drive subpixel circuit. Increased subpixel complexity reduces yield, because the finer features required are more vulnerable to fabrication errors. Particularly in typical bottom-emitting configurations, increased total size of the subpixel electronics increases power consumption because it reduces the aperture ratio, the percentage of each subpixel which emits light. Light emission of an OLED is proportional to area at a fixed current, so an OLED device with a smaller aperture ratio requires more current to produce the same luminance as an OLED with a larger aperture ratio. Additionally, higher currents in smaller areas increase current density in the OLED device, which accelerates $V_{oled}$ rise and OLED efficiency loss.

In-pixel measurement $V_{th}$ compensation schemes add additional circuitry to each subpixel to allow values representative of $V_{th}$ shift to be measured. Off-panel circuitry then processes the measurements and adjusts the drive of each subpixel to compensate for $V_{th}$ shift. For example, Nathan et al., in US 2006/0273997(A1), teach a four-transistor pixel circuit which allows TFT degradation data to be measured as either current under given voltage conditions or voltage under given current conditions. Nara et al., in U.S. Pat. No. 7,199,602, teach adding an inspection interconnect to a display, and adding a switching transistor to each pixel of the display to connect it to the inspection interconnect. Kimura et al., in U.S. Pat. No. 6,518,962, teach adding correction TFTs to each pixel of a display to compensate for EL degradation. These methods share the disadvantages of in-pixel $V_{th}$ compensation schemes, but some can additionally compensate for $V_{oled}$ shift or OLED efficiency loss.

Reverse-bias $V_{th}$ compensation schemes use some form of reverse voltage bias to shift $V_{th}$ back to some starting point. These methods cannot compensate for $V_{oled}$ rise or OLED efficiency loss. For example, Lo et al., in U.S. Pat. No. 7,116,058, teach modulating the reference voltage of the storage capacitor in an active-matrix pixel circuit to reverse-bias the drive transistor between each frame. Applying reverse-bias within or between frames prevents visible artifacts, but reduces duty cycle and thus peak brightness. Reverse-bias methods can compensate for the average $V_{th}$ shift of the panel with less increase in power consumption than in-pixel compensation methods, but they require more complicated external power supplies, can require additional pixel circuitry or signal lines, and may not compensate individual subpixels that are more heavily faded than others.

Considering $V_{oled}$ shift and OLED efficiency loss, U.S. Pat. No. 6,995,519 by Arnold et al. is one example of a method that compensates for aging of an OLED device. This method assumes that the entire change in device luminance is caused by changes in the OLED emitter. However, when the drive transistors in the circuit are formed from a-Si, this assumption is not valid, as the threshold voltage of the transistors also changes with use. The method of Arnold will thus not provide complete compensation for subpixel aging in circuits wherein transistors show aging effects. Additionally, when methods such as reverse bias are used to mitigate a-Si transistor threshold voltage shifts, compensation of OLED efficiency loss can become unreliable without appropriate tracking/prediction of reverse bias effects, or a direct measurement of the OLED voltage change or transistor threshold voltage change.

Alternative methods for compensation measure the light output of each subpixel directly, as taught e.g. by Young et al. in U.S. Pat. No. 6,489,631. Such methods can compensate for changes in all three aging factors, but require either a very high-precision external light sensor, or integrated light sensors in each subpixel. An external light sensor adds to the cost and complexity of a device, while integrated light sensors increase subpixel complexity and electronics size, with attendant performance reductions.

Existing $V_{th}$ compensation schemes are not without drawbacks, and few of them compensate for $V_{oled}$ rise or OLED efficiency loss. Those that compensate each subpixel for $V_{th}$ shift do so at the cost of panel complexity and lower yield. There is a continuing need, therefore, for improving compensation to overcome these objections to compensate for EL panel degradation and prevent objectionable visible burn-in over the entire lifetime of an EL display panel.

SUMMARY OF THE INVENTION

In accordance with the present invention, there is provided apparatus for providing an analog drive transistor control signal to the gate electrode of a drive transistor in a drive circuit that applies current to an EL device, the drive circuit including a voltage supply electrically connected to a first supply electrode of the drive transistor and the EL device electrically connected to a second supply electrode of the drive transistor, comprising:

a) a measuring circuit for measuring the current passing through the first and second supply electrodes at different times to provide an aging signal representing variations in the characteristics of the drive transistor and EL device caused by operation of the drive transistor and EL device over time;

b) means for providing a linear code value, c) a compensator for changing the linear code value in response to the aging signal to compensate for the variations in the characteristics of the drive transistor and EL device; and d) a linear source driver for producing the analog drive transistor control signal in response to the changed linear code value for driving the gate electrode of the drive transistor.

There is also provided a method for providing an analog drive transistor control signal to the gate electrode of a drive transistor in a drive circuit that applies current to an EL device, the drive circuit including a voltage supply electrically connected to a first supply electrode of the drive transistor and the EL device electrically connected to a second supply electrode of the drive transistor, comprising:

a) measuring the current passing through the first and second supply electrodes at different times to provide an aging signal representing variations in the characteristics of the drive transistor and EL device caused by operation of the drive transistor and EL device over time;

b) providing a linear code value;

c) changing the linear code value in response to the aging signal to compensate for the variations in the characteristics of the drive transistor and EL device; and d) providing a linear source driver for producing the analog drive transistor control signal in response to the changed linear code value for driving the gate electrode of the drive transistor.

There is further provided, an apparatus for providing analog drive transistor control signals to the gate electrodes of drive transistors in a plurality of EL subpixels in an EL panel, including a first voltage supply, a second voltage supply, and a plurality of EL subpixels in the EL panel; an EL device in a drive circuit for applying current to the EL device in each EL subpixel; each drive circuit including a drive transistor with a first supply electrode electrically connected to the first voltage supply and a second supply electrode electrically connected to a first electrode of the EL device; and each EL device including a second electrode electrically connected to the second voltage supply, the improvement comprising:

a) a measuring circuit for measuring the current passing through the first and second voltage supplies at different times to provide an aging signal for each subpixel representing variations in the characteristics of the drive transistor and EL device caused by operation of the drive transistor and EL device of that subpixel over time;

b) means for providing a linear code value for each subpixel;

c) a compensator for changing the linear code values in response to the aging signals to compensate for the variations in the characteristics of the drive transistor and EL device in each subpixel; and d) a linear source driver for producing the analog drive transistor control signals in response to the changed linear code values for driving the gate electrodes of the drive transistors.

ADVANTAGES

The present invention provides an effective way of providing the analog drive transistor control signal. It requires only one measurement to perform compensation. It can be applied to any active-matrix backplane. The compensation of the control signal has been simplified by using a look-up table (LUT) to change signals from nonlinear to linear so compensation can be in linear voltage domain. It compensates for $V_{th}$ shift, $V_{oled}$ shift, and OLED efficiency loss without requiring complex pixel circuitry or external measurement devices. It does not decrease the aperture ratio of a subpixel. It has no effect on the normal operation of the panel.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

The present invention compensates for degradation in the drive transistors and EL devices on an active-matrix EL display panel. In one embodiment, it compensates for $V_{th}$ shift, $V_{oled}$ shift, and OLED efficiency loss of all subixels on an active-matrix OLED panel. A panel comprises a plurality of pixels, each of which comprises one or more subpixels. For example, each pixel might comprise a red, a green, and a blue subpixel. Each subpixel comprises an EL device, which emits light, and surrounding electronics. A subpixel is the smallest addressable element of a panel. The EL device can be an OLED device.

The discussion to follow first considers the system as a whole. It then proceeds to the electrical details of a subpixel, followed by the electrical details for measuring one subpixel and the timing for measuring multiple subpixels. It next covers how the compensator uses measurements. Finally, it describes how this system is implemented in one embodiment, e.g. in a consumer product, from the factory to end-of-life.

Overview

Figure 1:
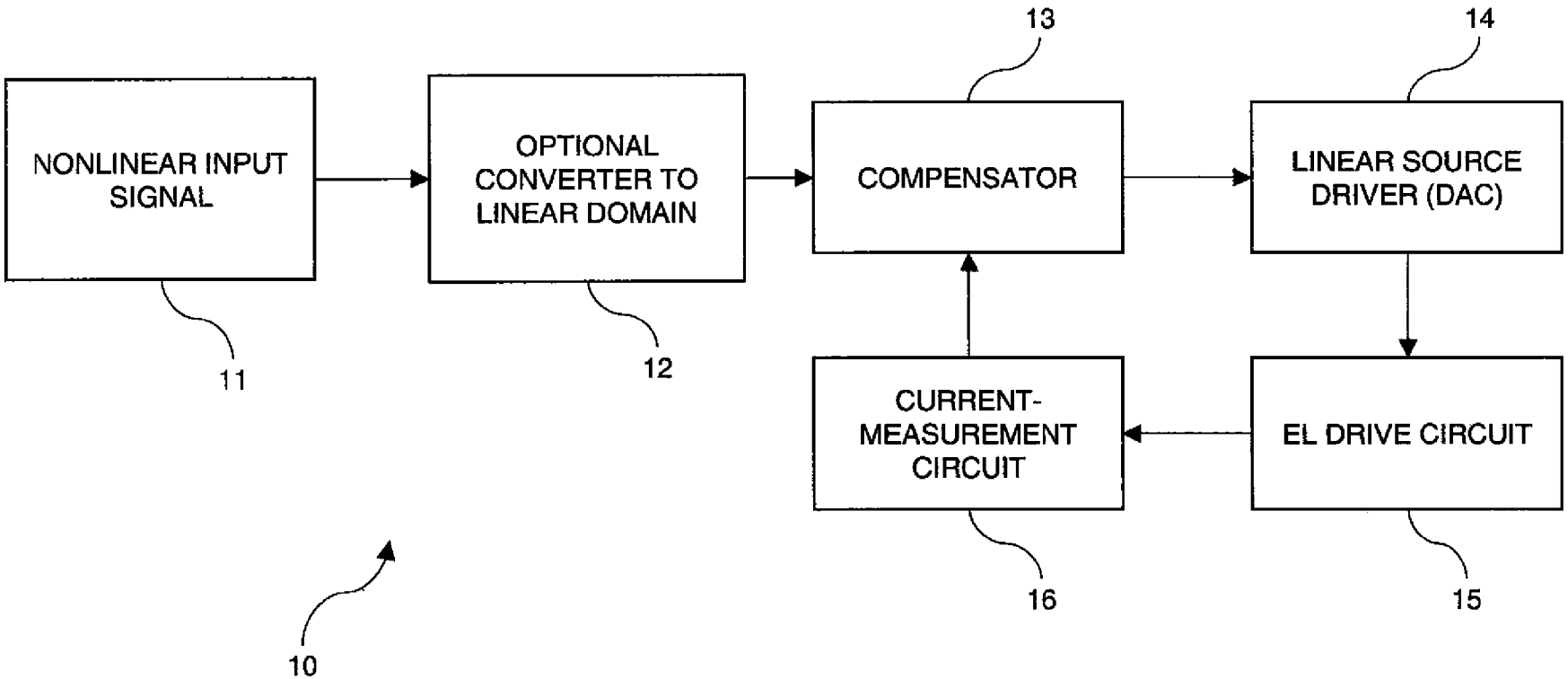
FIG. 1 is a block diagram of a control system for practicing the present invention.

FIG. 1 shows a block diagram of the overall system 10 of the present invention. The nonlinear input signal 11 commands a particular light intensity from an EL device in an EL subpixel, which can be one of many on an EL panel. This signal 11 can come from a video decoder, an image processing path, or another signal source, can be digital or analog, and can be nonlinearly- or linearly-coded. For example, the nonlinear input signal can be an sRGB code value step 74 or an NTSC luma voltage step 75. Whatever the source and format, the signal can preferentially be converted into a digital form and into a linear domain, such as linear voltage, by a converter 12, which will be discussed further in "Cross-domain processing, and bit depth", below. A look-up table or function analogous to an LCD source driver can perform this conversion. The result of the conversion will be a linear code value, which can represent a commanded drive voltage.

The compensator 13 takes in the linear code value, which can correspond to the particular light intensity commanded from the EL subpixel. Variations in the drive transistor and EL device caused by operation of the drive transistor and EL device in the EL subpixel over time mean that the EL subpixel will generally not produce the commanded light intensity in response to the linear code value. The compensator 13 outputs a changed linear code value that will cause the EL subpixel to produce the commanded intensity. The operation of the compensator will be discussed further in "Implementation," below.

The changed linear code value from the compensator 13 is passed to a linear source driver 14 which can be a digital-to-analog converter. The linear source driver 14 produces an analog drive transistor control signal, which can be a voltage, in response to the changed linear code value. The linear source driver 14 can be a source driver designed to be linear, or a conventional LCD or OLED source driver with its gamma voltages set to produce an approximately linear output. In the latter case, any deviations from linearity will affect the quality of the results. The linear source driver 14 can also be a time-division (digital-drive) source driver, as taught e.g. in commonly assigned WO 2005/116971 A1 by Kawabe. In this case, the analog voltage from the source driver is set at a predetermined level commanding light output for an amount of time dependent on the output signal from the compensator. A conventional linear source driver, by contrast, provides an analog voltage at a level dependent on the output signal from the compensator for a fixed amount of time (generally the entire frame). A linear source driver can output one or more analog drive transistor control signals simultaneously. In one embodiment of the present invention, an EL panel can have a linear source driver including one or more microchips and each microchip can output one or more analog drive transistor control signals, so that there are simultaneously produced a number of analog drive transistor control signals equal to the number of columns of EL subpixels in the EL panel.

The analog drive transistor control signal produced by the linear source driver 14 is provided to an EL drive circuit 15, which can be an EL subpixel. This circuit comprises a drive transistor and an EL device, as will be discussed in "Display element description," below. When the analog voltage is provided to the gate electrode of the drive transistor, current flows through the drive transistor and EL device, causing the EL device to emit light. There is generally a linear relationship between current through the EL device and luminance of the output device, and a nonlinear relationship between voltage applied to the drive transistor and current through the EL device. The total amount of light emitted by an EL device during a frame can thus be a nonlinear function of the voltage from the linear source driver 14.

The current flowing through the EL drive circuit is measured under specific drive conditions by a current-measurement circuit 16, as will be discussed further in "Data collection," below. The measured current for the EL subpixel provides the compensator with the information it needs to adjust the commanded drive signal. This will be discussed further in "Algorithm," below.

This system can compensate for variations in drive transistors and EL devices in an EL panel over the operational lifetime of the EL panel, as will be discussed further in "Sequence of operations," below.

Display Element Description

Figure 10:
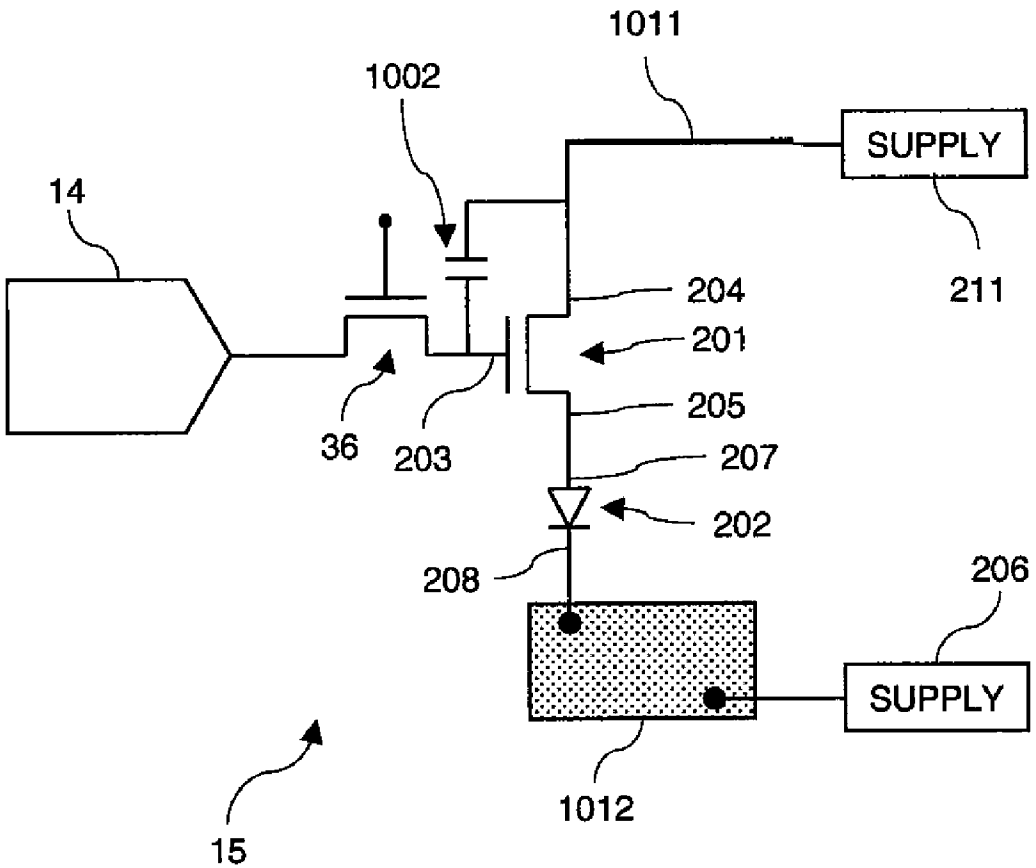
FIG. 10 is a detailed schematic of a drive circuit according to the present invention.

FIG. 10 shows a drive circuit 15 that applies current to an EL device, such as an OLED device. Drive circuit 15 comprises a drive transistor 201, which can be an amorphous silicon transistor, an EL device 202, a first voltage supply 211 ("PVDD"), which can be positive, and a second voltage supply 206 ("Vcom"), which can be negative. The EL device 202 has a first electrode 207 and a second electrode 208. The drive transistor has a gate electrode 203, a first supply electrode 204 which can be the drain of the drive transistor, and a second supply electrode 205 which can be the source of the drive transistor. An analog drive transistor control signal can be provided to the gate electrode 203, optionally through a select transistor 36. The analog drive transistor control signal can be stored on storage capacitor 1002. The first supply electrode 204 is electrically connected to the first voltage supply 211. The second supply electrode is electrically connected to the first electrode 207 of the EL device 202. The second electrode 208 of the EL device is electrically connected to the second voltage supply 206. The drive transistor 201 and EL device 202, together with the optional select transistor 36 and storage capacitor 1002, constitute an EL subpixel, that portion of the drive circuit that typically exists on an EL panel. The power supplies are typically located off the EL panel. Electrical connection can be made through switches, bus lines, conducting transistors, or other devices or structures capable of providing a path for current.

In one embodiment of the present invention, first supply electrode 204 is electrically connected to first voltage supply 211 through PVDD bus line 1011, second electrode 208 is electrically connected to second voltage supply 206 through sheet cathode 1012, and the analog drive transistor control signal for is provided to gate electrode 203 by linear source driver 14.

The present invention provides an analog drive transistor control signal to the gate electrode of the drive transistor. In order to provide a control signal, which compensates for variations in the characteristics of the drive transistor and EL device caused by operation of the drive transistor and EL device over time, that variation must be known. The variation is determined by measuring the current passing through the first and second supply electrodes of the drive transistor at different times to provide an aging signal representing the variations. This will be described in detail below, in "Algorithm." The aging signal can be digital or analog. It can be a representation of a voltage or a current.

Figure 2:
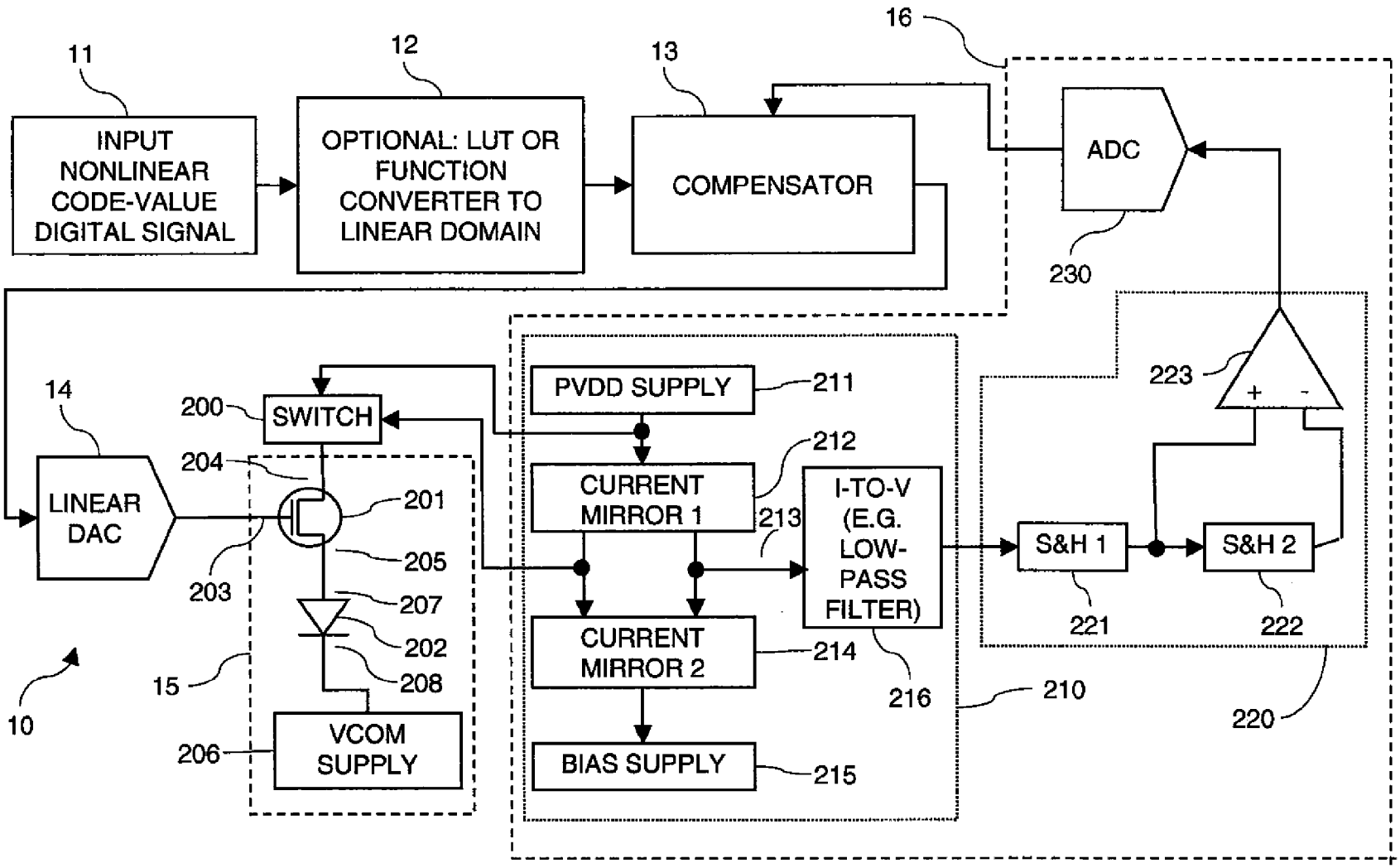
FIG. 2 is a schematic of a more detailed version of the block diagram of FIG. 1.

FIG. 2 shows the drive circuit 15 in the context of the whole system, including nonlinear input signal 11, converter 12, compensator 13, and linear source driver 14 as shown on FIG. 1. As described above, the drive transistor 201 has with gate electrode 203, first supply electrode 204 and second supply electrode 205. The EL device 202 has first electrode 207 and second electrode 208. The system has voltage supplies 211 and 206. Note that first voltage supply 211 is shown outside drive circuit 15 for clarity in the discussion of the current mirror unit 210, below.

The behavior of the drive transistor 201, which is generally a FET, and EL device 202 is such that essentially the same current passes from first voltage supply 211, through the first supply electrode 204 and the second supply electrode 205, through the EL device electrodes 207 and 208, to the second voltage supply 206. Therefore, current can be measured at any point in that chain. Current can be measured off the EL panel at the first voltage supply 211 to reduce the complexity of the EL subpixel. In one embodiment, the present invention uses a current mirror unit 210, a correlated double-sampling unit 220, and an analog-to-digital converter 230. These will be described in detail below, in "Data collection."

The drive circuit 15 shown in FIG. 2 is for an N-channel drive transistor and a non-inverted EL structure. In this case the EL device 202 is tied to the source 205 of the drive transistor 201, higher voltages on the gate electrode 203 command more light output, and voltage supply 211 is more positive than second voltage supply 206, so current flows from 211 to 206. However, this invention is applicable to any combination of P- or N-channel drive transistors and non-inverted or inverted EL devices. This invention is also applicable to LTPS or a-Si drive transistors.

Data Collection

Hardware

Still referring to FIG. 2, to measure the current of each EL subpixel without relying on any special electronics on the panel, the present invention employs a measuring circuit 16 comprising a current mirror unit 210, a correlated double-sampling (CDS) unit 220, and an analog-to-digital converter (ADC) 230.

The current mirror unit 210 is attached to voltage supply 211, although it can be attached to supply 211, supply 206, or anywhere else in the current path passing through the EL device and the first and second supply electrodes of the drive transistor. This is the path of the drive current, which causes the EL device to emit light. First current mirror 212 supplies drive current to the EL drive circuit 15 through switch 200, and produces a mirrored current on its output 213. The mirrored current can be equal to the drive current. In general, it can be a function of the drive current. For example, the mirrored current can be a multiple of the drive current to provide additional measurement-system gain. Second current mirror 214 and bias supply 215 apply a bias current to the first current mirror 212 to reduce voltage variations in the first current mirror, so that measurements are not affected by parasitic impedances in the circuit. This circuit also reduces changes in the current through the EL subpixels being measured due to voltage changes in the current mirror resulting from current draw of the measurement circuit. This advantageously improves signal-to-noise ratio over other current-measurement options, such as a simple sense resistor, which can change voltages at the drive transistor terminals depending on current. Finally, current-to-voltage (I-to-V) converter 216 converts the mirrored current from the first current mirror into a voltage signal for further processing. I-to-V converter 216 can comprise a transimpedance amplifier or a low-pass filter. For a single EL subpixel, the output of the I-to-V converter can be the aging signal for that subpixel. For measurements of multiple subpixels, as will be discussed below, the measurement circuitry can include further circuitry responsive to the voltage signal for producing an aging signal. As the characteristics of the drive transistor and EL device vary due to operation of the drive transistor and EL device over time, $V_{th}$ and $V_{oled}$ will vary, as described above. Consequently, the measured current, and thus the aging signal, will change in response to these variations. This will be discussed further in "Algorithm", below.

In one embodiment, first voltage supply 211 can have a potential of +15VDC, second power supply 206 −5VDC, and bias supply 215 −16VDC. The potential of the bias supply 215 can be selected based on the potential of the first voltage supply 211 to provide a stable bias current at all measurement current levels.

When EL subpixels are not being measured, the current mirror can be electrically disconnected from the panel by switch 200, which can be a relay or FET. The switch can selectively electrically connect the measuring circuit to the drive current flow through the first and second electrodes of the drive transistor 201. During measurement, the switch 200 can electrically connect first voltage supply 211 to first current mirror 212 to allow measurements. During normal operation, the switch 200 can electrically connect first voltage supply 211 directly to first supply electrode 204 rather than to first current mirror 212, thus removing the measuring circuit from the drive current flow. This causes the measurement circuitry to have no effect on normal operation of the panel. It also advantageously allows the measurement circuit's components, such as the transistors in the current mirrors 212 and 214, to be sized only for measurement currents and not for operational currents. As normal operation generally draws much more current than measurement, this allows substantial reduction in the size and cost of the measurement circuit.

Sampling

The current mirror unit 210 allows measurement of the current for one EL subpixel. To measure the current for multiple subpixels, in one embodiment the present invention uses correlated double-sampling, with a timing scheme usable with standard OLED source drivers.

Figure 3:
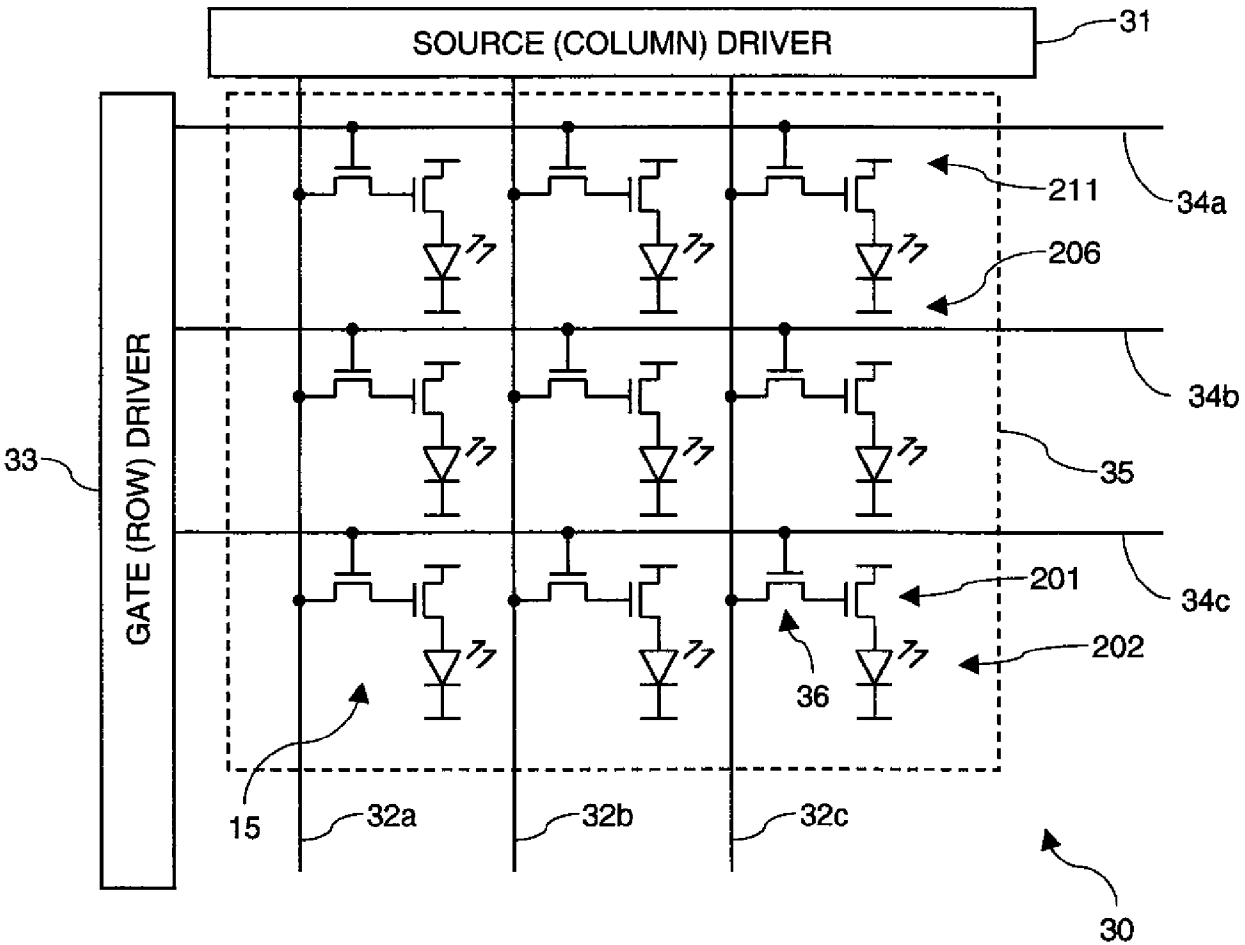
FIG. 3 is a diagram of a typical OLED panel.

Referring to FIG. 3, an EL panel 30 useful in the present invention has three main components: a source driver 31 driving column lines 32*a*, 32*b*, 32*c*, a gate driver 33 driving row lines 34*a*, 34*b*, 34*c*, and a subpixel matrix 35. In one embodiment of the present invention, the source driver 31 can be a linear source driver 14. Note that the source and gate drivers can comprise one or more microchips. Note also that the terms "row" and "column" do not imply any particular orientation of the EL panel. The subpixel matrix comprises a plurality of EL subpixels, generally identical, and generally arranged in an array of rows and columns. Each EL subpixel includes a drive circuit 15 including an EL device 202. Each drive circuit applies current to its EL device, and includes a select transistor 36 and a drive transistor 201. Select transistor 36, which acts as a switch, electrically connects the row and column lines to the drive transistor 201. The select transistor's gate is electrically connected to the appropriate row line 34, and of its source and drain electrodes, one is electrically connected to the appropriate column line 32, and one is connected to the gate electrode of the drive transistor. Whether the source is connected to the column line or the drive transistor gate electrode does not affect the operation of the select transistor. In one embodiment of the present invention, each EL device 202 in the subpixel matrix 35 can be an OLED device, and each drive transistor 201 in the subpixel matrix 35 can be an amorphous silicon transistor.

The EL panel also includes first voltage supply 211 and second voltage supply 206. Referring to FIG. 10, current can be supplied to the drive transistors 201 by PVDD bus lines e.g. 1011 electrically connecting the first supply electrodes 204 of the drive transistors with first voltage supply 211. A sheet cathode 1012 electrically connecting the second electrodes 208 of the EL devices 202 with second voltage supply 206 can complete the current path. Referring back to FIG. 3, for clarity, the voltage supplies 211 and 206 are indicated on FIG. 3 where they connect to each subpixel, as the present invention can be employed with a variety of schemes for connecting the supplies with the subpixels. The second supply electrode 205 of each drive transistor can be electrically connected to the first electrode 207 of its corresponding EL device.

As shown on FIG. 2, the EL panel can include a measuring circuit 16 electrically connected to the first voltage supply 211. This circuit measures the current passing through the first and second voltage supplies, which are the same by Kirchhoff's Current Law.

In typical operation of this panel, the source driver 31 drives appropriate analog drive transistor control signals on the column lines 32. The gate driver 33 then activates the first row line 34*a*, causing the appropriate control signals to pass through the select transistors 36 to the gate electrodes of the appropriate drive transistors 201 to cause those transistors to apply current to their attached EL devices 202. The gate driver then deactivates the first row line 34*a*, preventing control signals for other rows from corrupting the values passed through the select transistors. The source driver drives control signals for the next row on the column lines, and the gate driver activates the next row 34*b*. This process repeats for all rows. In this way all subpixels on the panel receive appropriate control signals, one row at a time. The row time is the time between activating one row line (e.g. 34*a*) and activating the next (e.g. 34*b*). This time is generally constant for all rows.

Figure 4A:
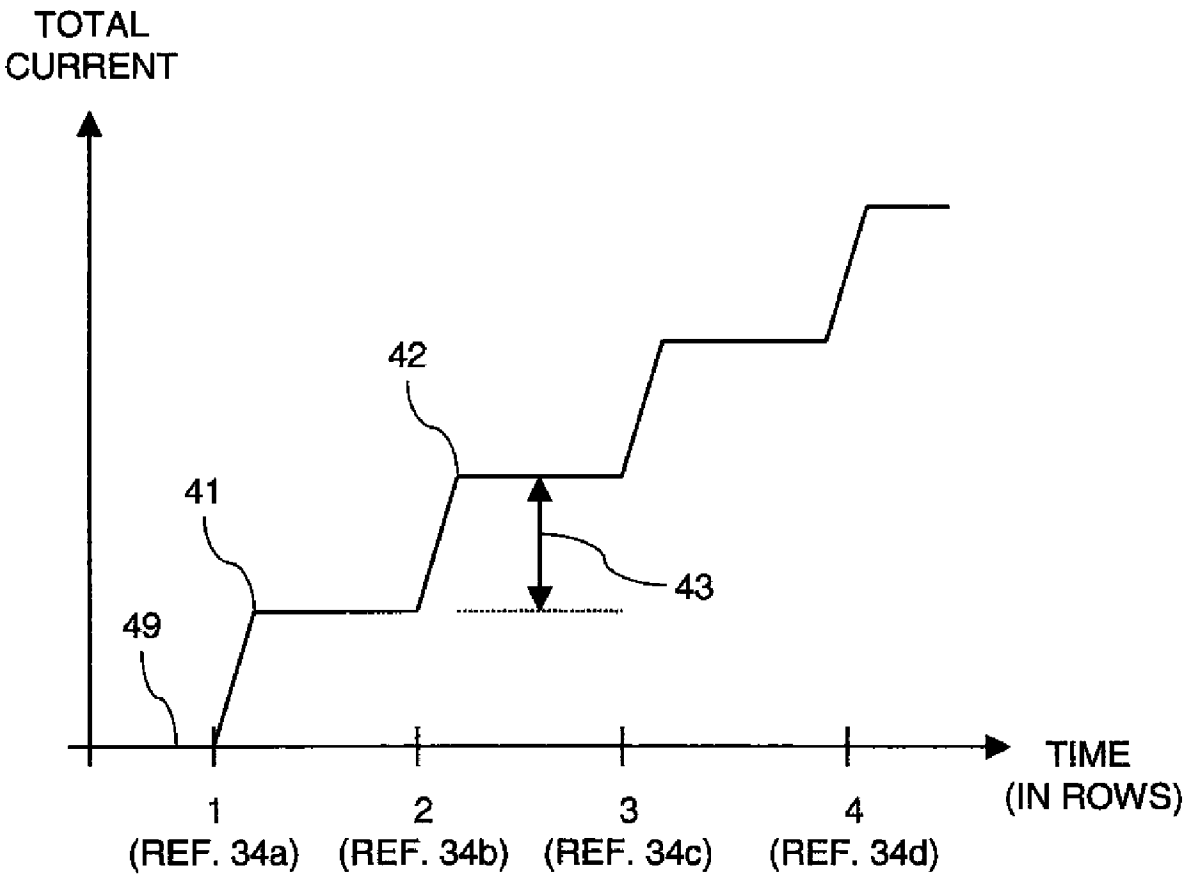
FIG. 4*a* is a timing diagram for operating the measurement circuit of FIG. 2 under ideal conditions.

According to the present invention, this row stepping is used advantageously to activate only one subpixel at a time, working down a column. Referring to FIG. 3, suppose only column 32*a* is driven, starting with all subpixels off. Column line 32*a* will have an analog drive transistor control signal, such as a high voltage, causing subpixels attached thereto to emit light; all other column lines 32*b* . . . 32*c* will have a control signal, such as a low voltage, causing subpixels attached thereto not to emit light. Since all subpixels are off, the panel can be drawing no current (but see "Sources of noise", below). Starting at the top row, rows are activated at the points indicated by the ticks on the time axis. As rows are activated, the subpixels attached to column 32*a* turn on, and so the total current drawn by the panel rises. Referring now to FIG. 4*a*, at time 1, a subpixel is activated (e.g. with row line 34*a*) and its current 41 measured with measuring circuit 16. Specifically, what is measured is the voltage signal from the current-measurement circuit, which represents the current through the first and second voltage supplies as discussed above; measuring the voltage signal representing current is referred to as "measuring current" for clarity. At time 2, the next subpixel is activated (e.g. with row line 34*b*) and current 42 is measured. Current 42 is the sum of the current from the first subpixel and the current from the second subpixel. The difference between the second measurement 42 and the first measurement 41 is the current 43 drawn by the second subpixel. In this way the process proceeds down the first column, measuring the current of each subpixel. The second column is then measured, then the third, and so forth for the rest of the panel. Note that each measurement (e.g. 41, 42) is taken as soon after activating a subpixel as possible. In an ideal situation, each measurement can be taken any time before activating the next subpixel, but as will be discussed below, taking measurements immediately after activating a subpixel can help remove error due to self-heating effects. This method allows measurements to be taken as fast as the settling time of a subpixel will allow.

Correlated double-sampling unit 220 samples the measured currents to produce aging signals. In hardware, currents are measured by latching their corresponding voltage signals from current mirror unit 210 into the sample-and-hold units 221 and 222 of FIG. 2. The voltage signals can be those produced by I-to-V converter 216. Differential amplifier 223 takes the differences between successive subpixel measurements. The output of sample-and-hold unit 221 is electrically connected to the positive terminal of differential amplifier 223 and the output of unit 222 is electrically connected to the negative terminal of amplifier 223. For example, when current 41 is measured, the measurement is latched into sample-and-hold unit 221. Then, before current 42 is measured (latched into unit 221), the output of unit 221 is latched into second sample-and-hold unit 222. Current 42 is then measured. This leaves current 41 in unit 222 and current 42 in unit 221. The output of the differential amplifier, the value in unit 221 minus the value in unit 222, is thus (voltage signal representing) current 42 minus (voltage signal representing) current 41, or difference 43. Each current difference, e.g. 43, can be the aging signal for a corresponding subpixel. For example, current difference 43 can be the aging signal for the subpixel attached to row line 34*b* and column line 32*a*. In this way, stepping down the rows and across the columns, measurements can be taken of each subpixel and an aging signal provided for each subpixel.

Sources of Noise

In practice, the current waveform can be other than a clean step, so measurements can be taken only after waiting for the waveform to settle. Multiple measurements of each subpixel can also be taken and averaged together. Such measurements can be taken consecutively before advancing to the next subpixel. Such measurements can also be taken in separate measurement passes, in which each subpixel on the panel is measured in each pass. Capacitance between voltage supplies 206 and 211 can add to the settling time. This capacitance can be intrinsic to the panel or provided by external capacitors, as is common in normal operation. It can be advantageous to provide a switch that can be used to electrically disconnect the external capacitors while taking measurements. This will reduce settling time.

All power supplies should be kept as clean as possible. Noise on any power supply will affect the current measurement. For example, noise on the power supply which the gate driver uses to deactivate rows (often called VGL or Voff, and typically around −8VDC) can capacitively couple across the select transistor into the drive transistor and affect the current, thus making current measurements noisier. If a panel has multiple power-supply regions, for example a split supply plane, those regions can be measured in parallel. Such measurement can isolate noise between regions and reduce measurement time.

One major source of noise can be the source driver itself. Whenever the source driver switches, its noise transients can couple into the power supply planes and the individual subpixels, causing measurement noise. To reduce this noise, the control signals out of the source driver can be held constant while stepping down a column. For example, when measuring a column of red subpixels on an RGB stripe panel, the red code value supplied to the source driver for that column can be constant for the entire column. This will eliminate source-driver transient noise.

Source driver transients can be unavoidable at the beginning and ends of columns, as the source driver has to change from activating the present column (e.g. 32*a*) to activating the next column (e.g. 32*b*). Consequently, measurements for the first and last one or more subpixels in any column can be subject to noise due to transients. In one embodiment, the EL panel can have extra rows, not visible to the user, above and below the visible rows. There can be enough extra rows that the source driver transients occur only in those extra rows, so measurements of visible subpixels do not suffer. In another embodiment, a delay can be inserted between the source driver transient at the beginning of a column and the measurement of the first row in that column, and between the measurement of the last row in that column and the source driver transient at the end of a column.

The panel can draw some current even when all subpixels are turned off. This "dark current" can be due to drive transistor leakage in cutoff. Dark current adds DC bias noise to the measured currents. It can be removed by taking a measurement with all subpixels off before activating the first subpixel, as shown by point 49 on FIG. 4*a*. In this case the current drawn by subpixel 1 would be measurement 41 minus measurement 49, rather than only measurement 41.

Current Stability

This discussion so far assumes that once a subpixel is turned on and settles to some current, it remains at that current for the remainder of the column. Two effects that can violate that assumption are storage-capacitor leaking and within-subpixel effects.

A storage capacitor, as known in the art, can be part of every subpixel, and can be electrically connected between the drive transistor gate and a reference voltage. Leakage current of the select transistor in a subpixel can gradually bleed off charge on the storage capacitor, changing the gate voltage of the drive transistor and thus the current drawn. Additionally, if the column line attached to a subpixel is changing value over time, it has an AC component, and therefore can couple through the parasitic capacitances of the select transistor onto the storage capacitor, changing the storage capacitor's value and thus the current drawn by the subpixel.

Figure 4B:
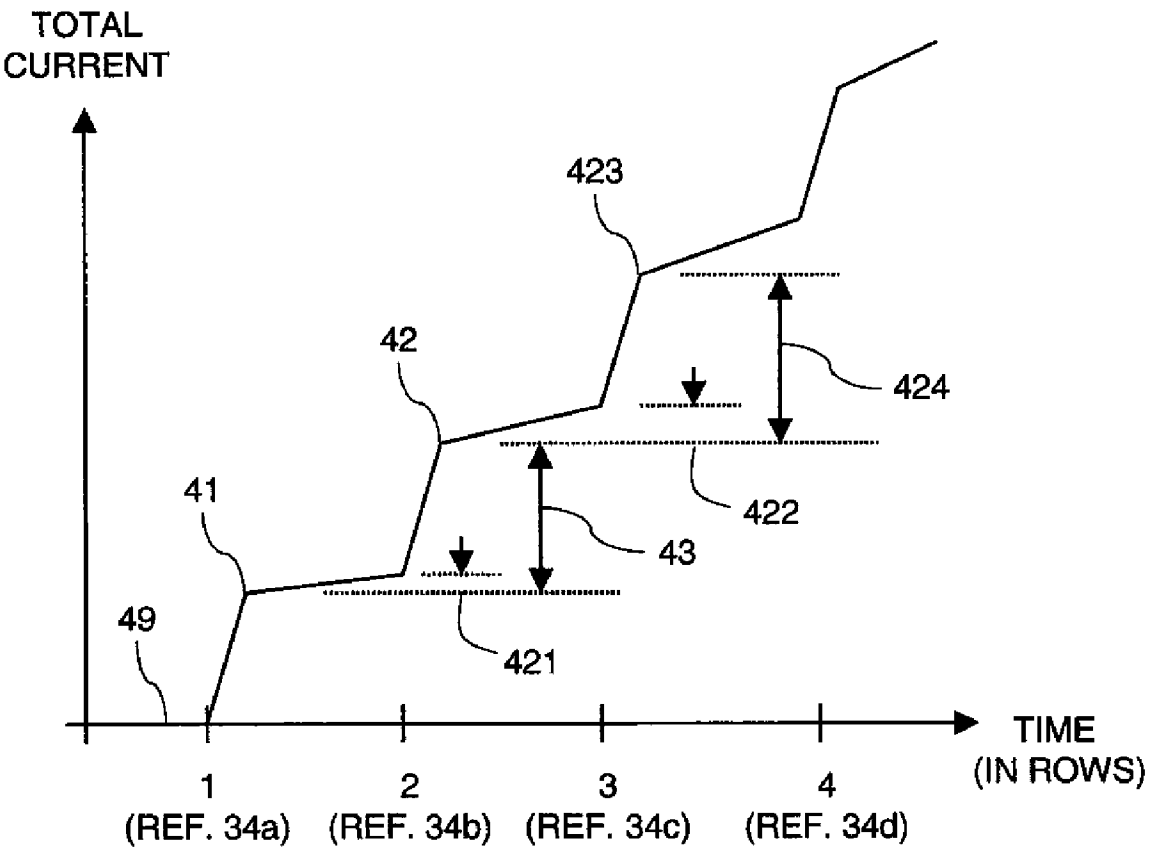
FIG. 4*b* is a timing diagram for operating the measurement circuit of FIG. 2 including error due to self-heating of subpixels.

Even when the storage capacitor's value is stable, within-subpixel effects can corrupt measurements. A common within-subpixel effect is self-heating of the subpixel, which can change the current drawn by the subpixel over time. The drift mobility of an a-Si TFT is a function of temperature; increasing temperature increases mobility (Kagan & Andry, op. cit., sec. 2.2.2, pp. 42-43). As current flows through the drive transistor, power dissipation in the drive transistor and in the EL device will heat the subpixel, increasing the temperature of the transistor and thus its mobility. Additionally, heat lowers $V_{oled}$; in cases where the OLED is attached to the source terminal of the drive transistor, this can increase $V_{gs}$ of the drive transistor. These effects increase the amount of current flowing through the transistor. Under normal operation, self-heating can be a minor effect, as the panel can stabilize to an average temperature based on the average contents of the image it is displaying. However, when measuring subpixel currents, self-heating can corrupt measurements. Referring to FIG. 4*b*, measurement 41 is taken as soon as possible after activating subpixel 1. This way self-heating of subpixel 1 does not affect its measurement. However, in the time between measurement 41 and measurement 42, subpixel 1 will self-heat, increasing current by amount 421. Therefore, the computed difference 43 representing the current of subpixel 2 will be in error; it will be too large by amount 421. Amount 421 is the rise in current per subpixel per row time.

To correct for self-heating effects and any other within-subpixel effects producing similar noise signatures, the self-heating can be characterized and subtracted off the known self-heating component of each subpixel. Each subpixel generally increases current by the same amount during each row time, so with each succeeding subpixel the self-heating for all active subpixels can be subtracted off. For example, to get subpixel 3's current 424, measurement 423 can be reduced by self-heating component 422, which is twice component 421: component 421 per subpixel, times two subpixels already active. The self-heating can be characterized by turning on one subpixel for tens or hundreds of row times and measuring its current periodically while it is on. The average slope of the current with respect to time can be multiplied by one row time to calculate the rise per subpixel per row time 421.

Error due to self-heating, and power dissipation, can be reduced by selecting a lower measurement reference gate voltage (FIG. 5*a* 510), but a higher voltage improves signal-to-noise ratio. Measurement reference gate voltage can be selected for each panel design to balance these factors.

Algorithm

Figure 5A:
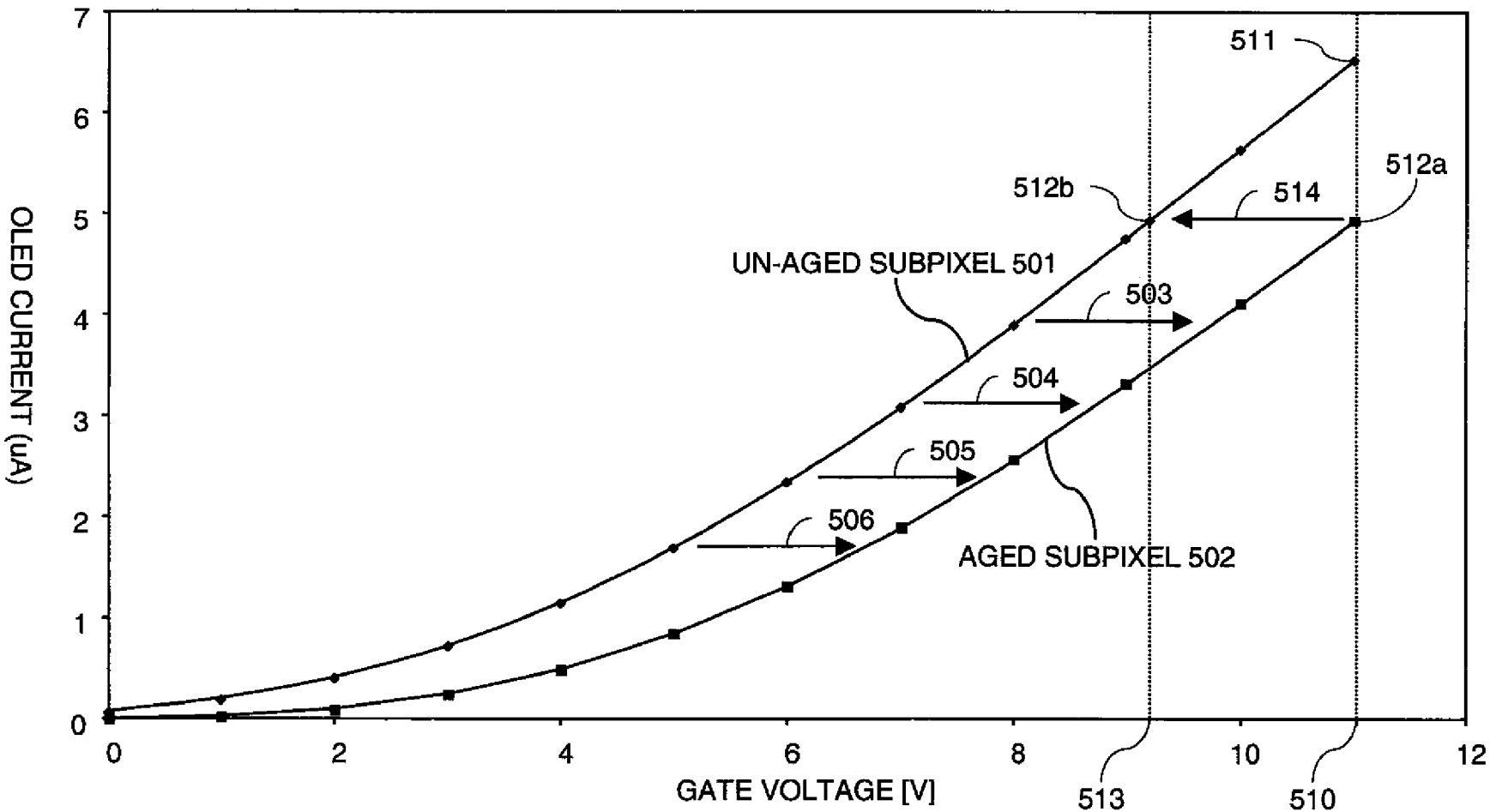
FIG. 5*a* is a representative I-V characteristic curve of unaged and aged subpixels, showing $V_{th}$ shift.

Referring to FIG. 5*a*, I-V curve 501 is a measured characteristic of a subpixel before aging. I-V curve 502 is a measured characteristic of that subpixel after aging. Curves 501 and 502 are separated by what is largely a horizontal shift, as shown by identical voltage differences 503, 504, 505, and 506 at different current levels. That is, the primary effect of aging is to shift the I-V curve on the gate voltage axis by a constant amount. This is in keeping with the MOSFET saturation-region drive transistor equation, $I_d=K(V_{gs}-V_{th})^2$ (Lurch, N. *Fundamentals of electronics,* 2*e*. New York: John Wiley & Sons, 1971, pg. 110): the drive transistor is operated, $V_{th}$ increases; and as $V_{th}$ increases, $V_{gs}$ must increase correspondingly to maintain $I_d$ constant. Therefore, constant $V_{gs}$ leads to lower $I_d$ as $V_{th}$ increases.

In the example of FIG. 5*a*, at a measurement reference gate voltage 510, the un-aged subpixel produced the current represented at point 511. The current is the aging signal for that subpixel. The aged sub-pixel, however, produces at that gate voltage the lower amount of current represented at point 512*a*. Points 511 and 512*a* can be two measurements of the same subpixel taken at different times. For example, point 511 can be a measurement at manufacturing time, and point 512*a* can be a measurement after some use by a customer. The current represented at point 512*a* would have been produced by the un-aged subpixel when driven with voltage 513 (point 512*b*), so a voltage shift $\Delta V_{th}$ 514 is calculated as the voltage difference between voltages 510 and 513. Voltage shift 514 is thus the shift required to bring the aged curve back to the un-aged curve. In this example, $\Delta V_{th}$ 514 is just under two volts. Then, to compensate for the $V_{th}$ shift, and drive the aged subpixel to the same current as the un-aged subpixel had, voltage difference 514 is added to every commanded drive voltage (linear code value). For further processing, percent current is also calculated as current 512*a* divided by current 511. An unaged subpixel will thus have 100% current. Percent current is used in several algorithms according to the present invention. Any negative current reading 511, such as might be caused by extreme environmental noise, can be clipped to 0, or disregarded. Note that percent current is always calculated at the measurement reference gate voltage 510.

In general, the current of an aged subpixel could be higher or lower than that of an un-aged subpixel. For example, higher temperatures cause more current to flow, so a lightly-aged subpixel in a hot environment could draw more current than an unaged subpixel in a cold environment. The compensation algorithm of the present invention can handle either case; $\Delta V_{th}$ 514 can be positive or negative (or zero, for unaged pixels). Similarly, percent current can be greater or less than 100% (or exactly 100%, for unaged pixels).

Since the voltage difference due to $V_{th}$ shift is the same at all currents, any single point on the I-V curve can be measured to determine that difference. In one embodiment, measurements are taken at high gate voltages, advantageously increasing signal-to-noise ratio of the measurements, but any gate voltage on the curve can be used.

Figure 5B:
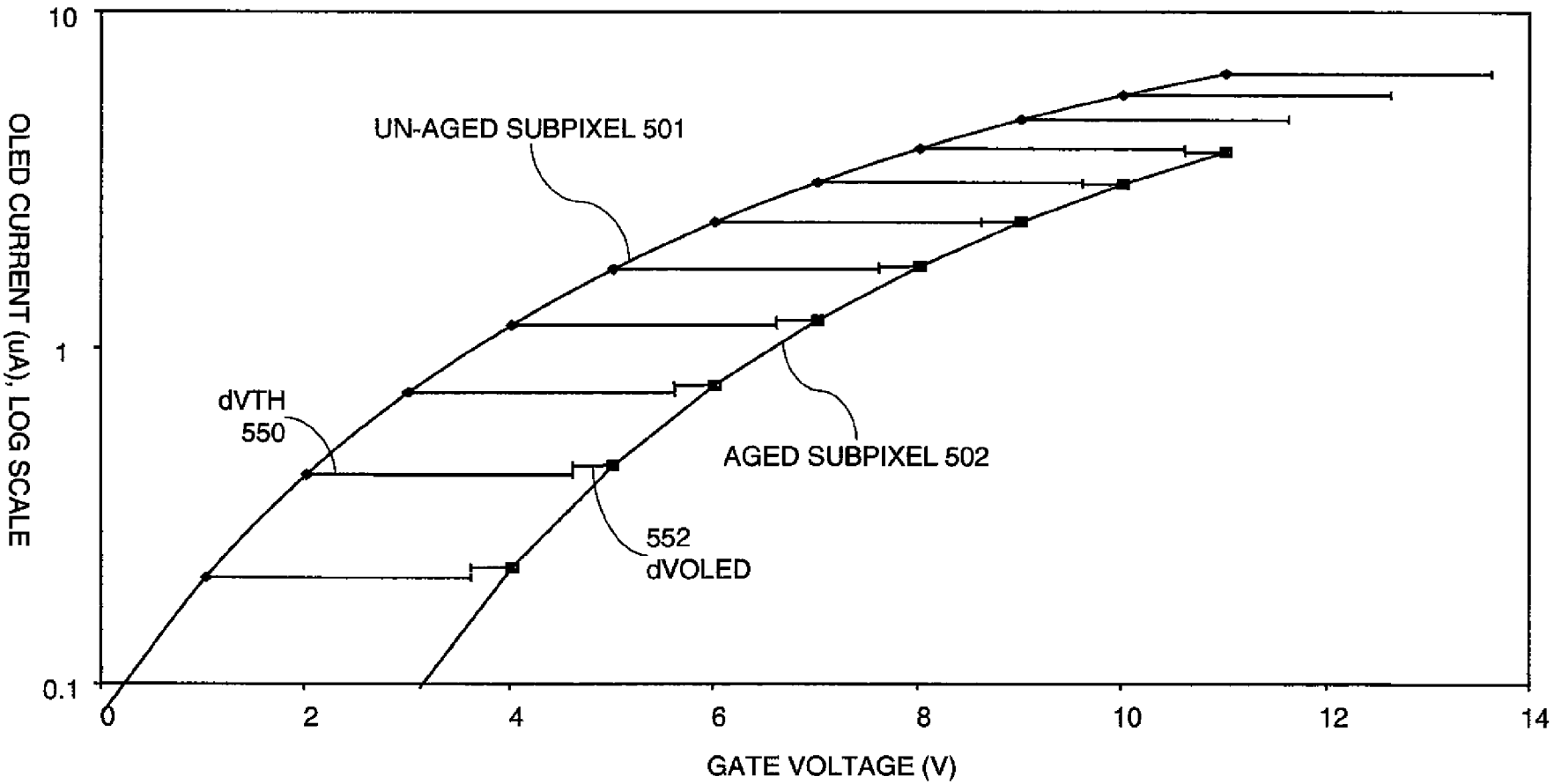
FIG. 5*b* is a representative I-V characteristic curve of unaged and aged subpixels, showing $V_{th}$ and $V_{oled}$ shift.

$V_{oled}$ shift is the secondary aging effect. As the EL device is operated, $V_{oled}$ shifts, causing the aged I-V curve to no longer be a simple shift of the un-aged curve. This is because $V_{oled}$ rises nonlinearly with current, so $V_{oled}$ shift will affect high currents differently than low currents. This effect causes the I-V curve to stretch horizontally as well as shifting. To compensate for $V_{oled}$ shift, two measurements at different drive levels can be taken to determine how much the curve has stretched, or the typical $V_{oled}$ shift of OLEDs under load can be characterized to allow estimation of $V_{oled}$ contribution in an open-loop manner. Both can produce acceptable results. Referring to FIG. 5*b*, an I-V curve on a semilog scale, components 550 are due to $V_{th}$ shift and components 552 are due to $V_{oled}$ shift. $V_{oled}$ shift can be characterized by driving an instrumented OLED subpixel with a typical input signal for a long period of time, and periodically measuring $V_{th}$ and $V_{oled}$. The two measurements can be made separately by providing a probe point on the instrumented subpixel between the OLED and the transistor. Using his characterization, percent current can be mapped to an appropriate $\Delta V_{th}$ and $\Delta V_{oled}$, rather than to a $V_{th}$ shift alone.

OLED efficiency loss is the tertiary aging effect. As an OLED ages, its efficiency decreases, and the same amount of current no longer produces the same amount of light. To compensate for this without requiring optical sensors or additional electronics, OLED efficiency loss as a function of $V_{th}$ shift can be characterized, allowing estimation of the amount of extra current required to return the light output to its previous level. OLED efficiency loss can be characterized by driving an instrumented OLED subpixel with a typical input signal for a long period of time, and periodically measuring $V_{th}$, $V_{oled}$ and $I_{oled}$ at various drive levels. Efficiency can be calculated as $I_{oled}/V_{oled}$, and that calculation can be correlated to $V_{th}$ or percent current. Note that this characterization achieves most effective results when $V_{th}$ shift is always forward, since $V_{th}$ shift is easily reversible but OLED efficiency loss is not. If $V_{th}$ shift is reversed, correlating OLED efficiency loss with $V_{th}$ shift can become complicated. For further processing, percent efficiency can be calculated as aged efficiency divided by new efficiency, analogously to the calculation of percent current described above.

Figure 9:
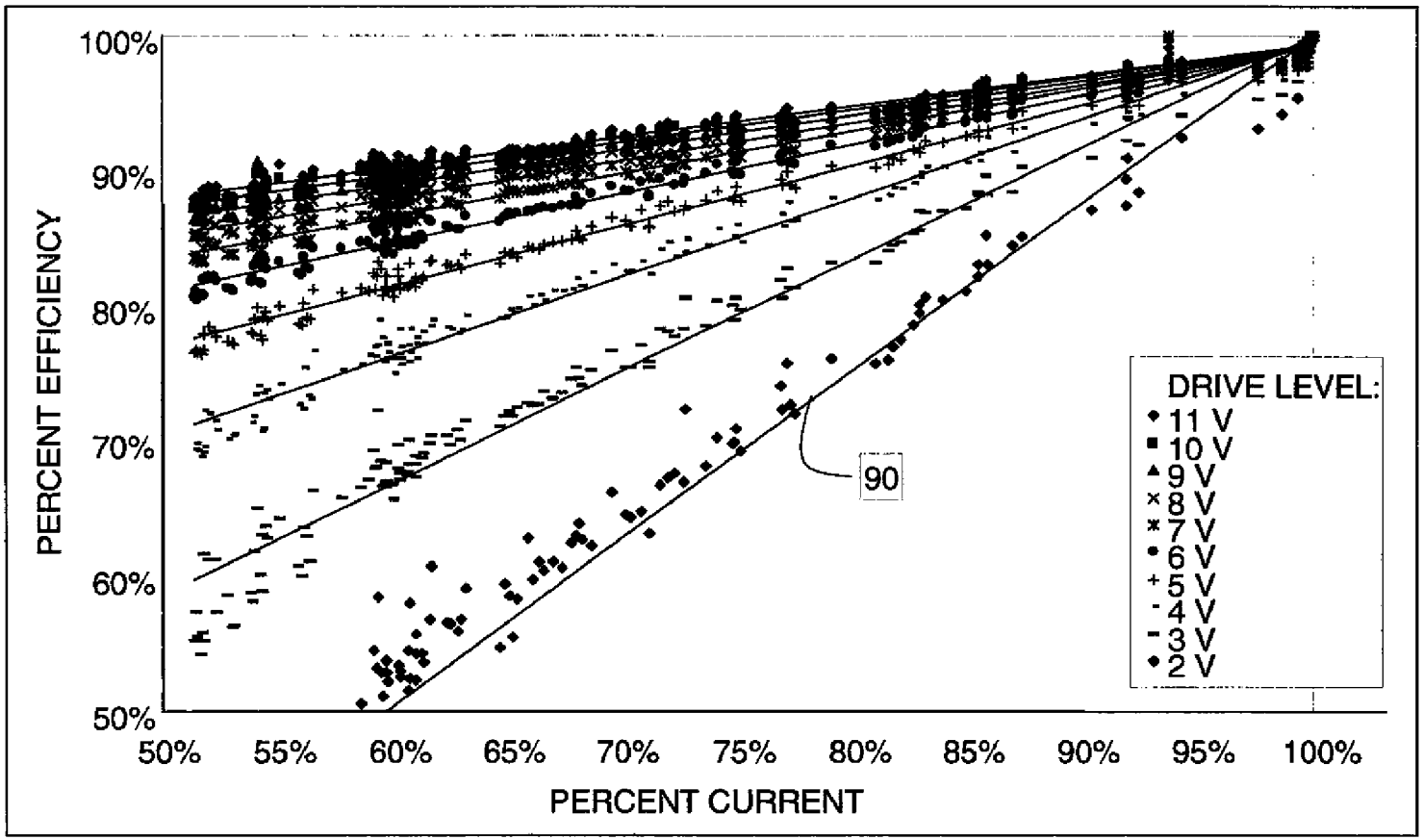
FIG. 9 is a representative plot showing percent efficiency as a function of percent current.

Referring to FIG. 9, there is shown an experimental plot of percent efficiency as a function of percent current at various drive levels, with linear fits e.g. 90 to the experimental data. As the plot shows, at any given drive level, efficiency is linearly related to percent current. This linear model allows effective open-loop efficiency compensation. Similar results are reported by Parker et al. in "Lifetime and degradation effects in polymer light-emitting diodes," *J. App. Phys.* 85.4 (1999): 2441-2447, particularly as shown in FIG. 12, p. 2445. Parker et al. also suggest that a single mechanism is responsible for both efficiency loss (luminance decrease) and $V_{oled}$ rise (voltage increase).

The characteristics of the drive transistor and EL device, including $V_{th}$ and $V_{oled}$, vary over time due to operation of the drive transistor and EL device over time. Percent current can be used as an aging signal representing, and enabling compensation for, these variations.

Although this algorithm has been described in the context of OLED devices, other EL devices can also be compensated for by applying these analyses as will be obvious to those skilled in the art.

Implementation

Figure 6A:
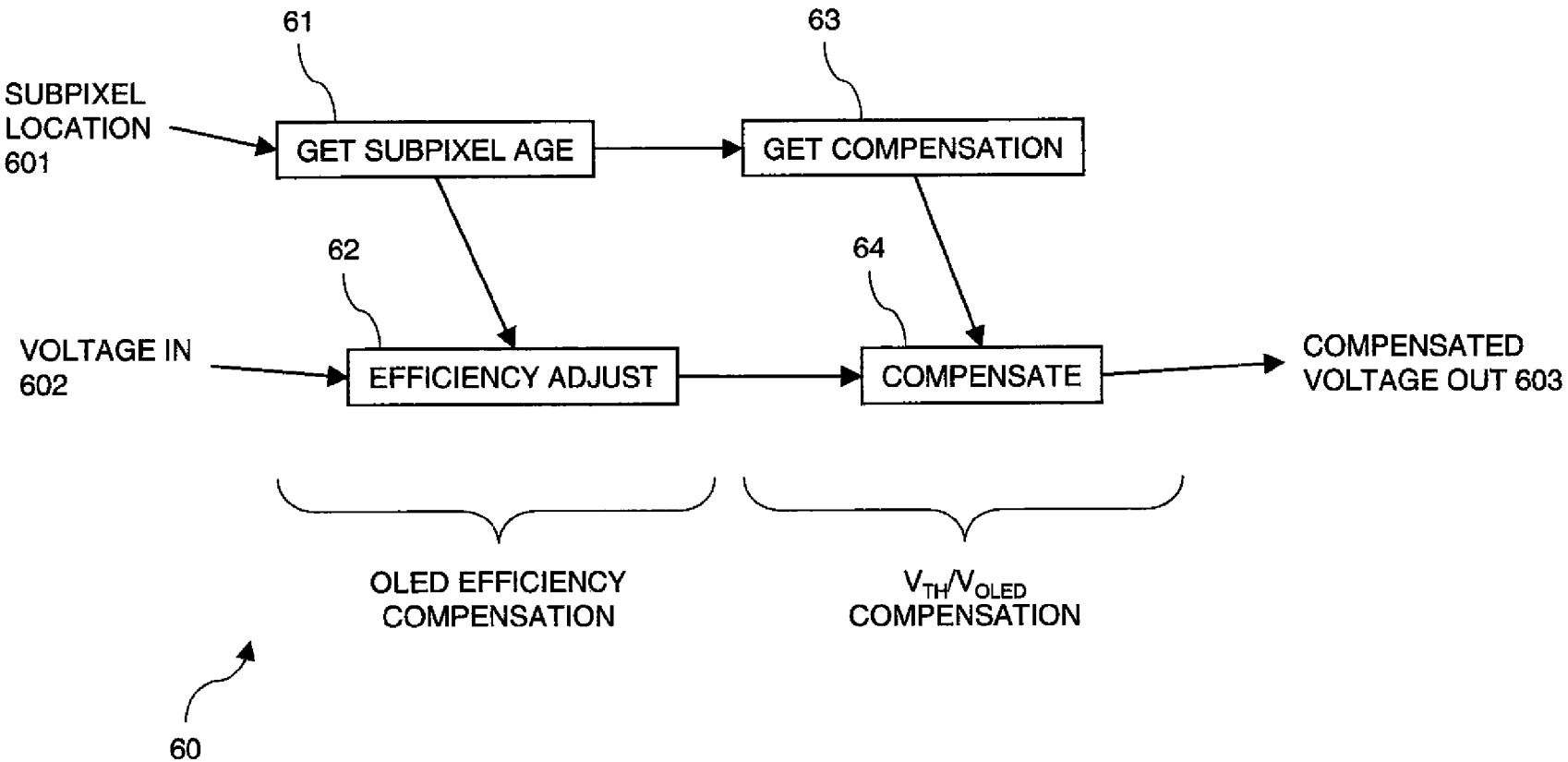
FIG. 6*a* is a high-level dataflow diagram of the compensator of FIG. 1.

Referring to FIG. 6*a*, there is shown an implementation of a compensator in which the linear code value is a commanded drive voltage and the changed linear code value is a compensated voltage. The compensator operates on one subpixel at a time; multiple subpixels can be processed serially. For example, compensation can be performed for each subpixel as its linear code value arrives from a signal source in the conventional left-to-right, top-to-bottom scanning order. Compensation can be performed on multiple pixels simultaneously by paralleling multiple copies of the compensation circuitry or by pipelining the compensator; these techniques will be obvious to those skilled in the art.

The inputs to compensator 60 are the position of a subpixel 601 and the linear code value of that subpixel 602, which can represent a commanded drive voltage. The compensator changes the linear code value to produce a changed linear code value for a linear source driver, which can be e.g. a compensated voltage out 603. The compensator can include four major blocks: determining a subpixel's age 61, optionally compensating for OLED efficiency 62, determining the compensation based on age 63, and compensating 64. Blocks 61 and 62 are primarily related to OLED efficiency compensation, and blocks 63 and 64 are primarily related to voltage compensation, specifically $V_{th}/V_{oled}$ compensation.

Figure 6B:
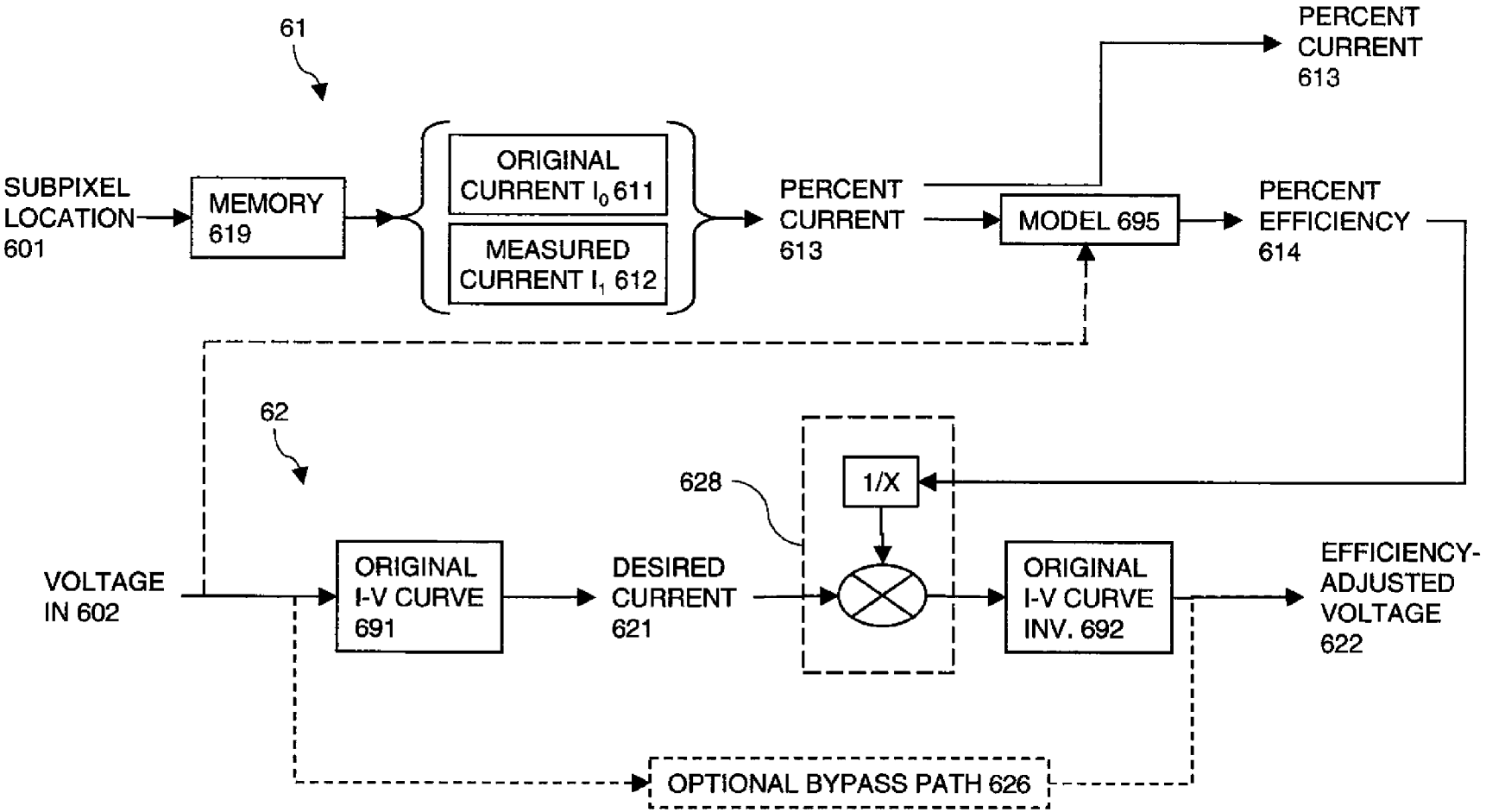
FIG. 6*b* is part one (of two) of a detailed dataflow diagram of the compensator.

FIG. 6*b* is an expanded view of blocks 61 and 62. The subpixel's location 601 is used to retrieve a stored reference aging signal measurement taken at manufacturing $i_0$ 611 and a most recent stored aging signal measurement $i_1$ 612. The aging signal measurements can be aging signals output by the measuring circuit described in "Data collection," above. The measurements can be measurements of the aging signal of the subpixel at position 601 at different times. These measurements can be stored in a memory 619, which can include nonvolatile RAM, such as a Flash memory, and ROM, such as EEPROM. The $i_0$ measurements can be stored in NVRAM or ROM; the $i_1$ measurements can be stored in NVRAM. Measurement 612 can be a single measurement, an average of a number of measurements, an exponentially-weighted moving average of measurements over time, or the result of other smoothing methods which will be obvious to those skilled in the art.

Percent current 613 can be calculated, as described above, as $i_1/i_0$, and can be 0 (dead pixel), 1 (no change), less than 1 (current loss) or greater than 1 (current gain). Generally it will be between 0 and 1, because the most recent aging signal measurement will be lower than the manufacturing-time measurement. Percent current can itself be an aging signal, as it represents variations in current just as the individual measurements $i_0$ and $i_1$ do, in which case it can be stored in memory 619 directly.

Percent current 613 is sent to the next processing stage 63, and is also input to a model 695 to determine the percent OLED efficiency 614. Model 695 outputs an efficiency 614 which is the amount of light emitted for a given current at the time of the most recent measurement, divided by the amount of light emitted for that current at manufacturing time. Any percent current greater than 1 can yield an efficiency of 1, or no loss, since efficiency loss can be difficult to calculate for pixels which have gained current. Model 695 can also be a function of the linear code value 602, as indicated by the dashed arrow, in cases where OLED efficiency depends on commanded current. Whether to include linear code value 602 as an input to model 695 can be determined by life testing and modeling of a panel design.

In parallel, the compensator receives a linear code value, for example commanded voltage in 602. This linear code value is passed through the original I-V curve 691 of the panel measured at manufacturing time to determine the desired current 621. This is divided by the percent efficiency 614 in operation 628 to return the light output for the desired current to its manufacturing-time value. The resulting, boosted current is then passed through curve 692, the inverse of curve 691, to determine what commanded voltage will produce the amount of light desired in the presence of efficiency loss. The value out of curve 692 is passed to the next stage as efficiency-adjusted voltage 622.

If efficiency compensation is not desired, input voltage 602 is sent unchanged to the next stage as efficiency-adjusted voltage 622, as indicated by optional bypass path 626. In this case the percent current 613 should still be calculated, but the percent efficiency 614 need not be.

Figure 6C:
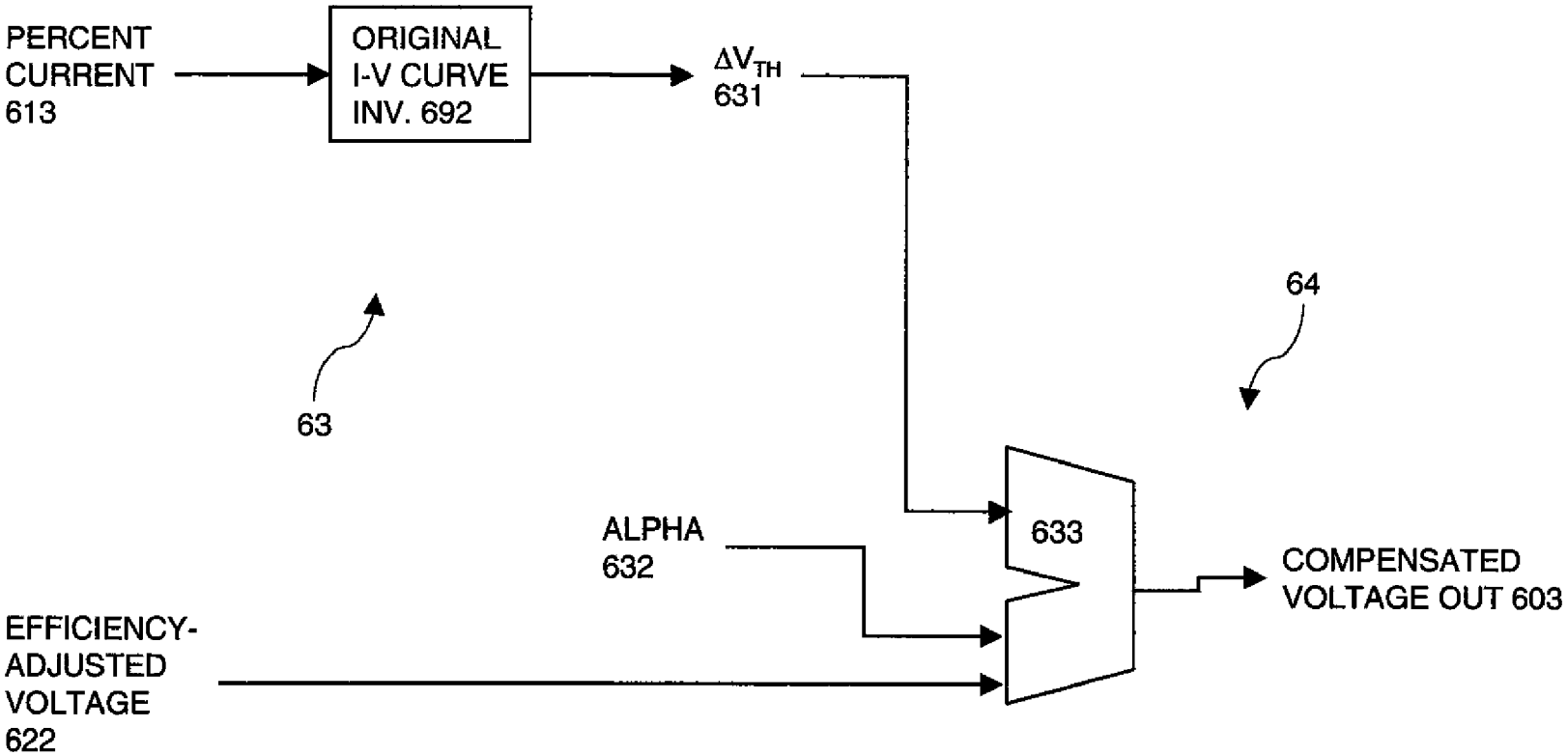
FIG. 6*c* is part two (of two) of a detailed dataflow diagram of the compensator.

FIG. 6*c* is an expanded view of FIG. 6*a*, blocks 63 and 64. It receives a percent current 613 and an efficiency-adjusted voltage 622 from the previous stages. Block 63, "Get compensation," comprises mapping the current loss 623 through the inverse I-V curve 692 and subtracting the result (513) from the measurement reference gate voltage (510) to find the $V_{th}$ shift $\Delta V_{th}$ 631. Block 64, "Compensate," comprises operation 633, which calculates the compensated voltage out 603 as given in Eq. 1:

$$V_{out}=V_{in}+\Delta V_{th}(1+\alpha(V_{g,ref}-V_{in})) \quad \text{(Eq. 1)}$$

where $V_{out}$ is 603, $\Delta V_{th}$ is 631, $\alpha$ is alpha value 632, $V_{g,ref}$ is the measurement reference gate voltage 510, and $V_{in}$ is the efficiency-adjusted voltage 622. The compensated voltage out can be expressed as a changed linear code value for a linear source driver, and compensates for variations in the characteristics of the drive transistor and EL device.

In the case of straight $V_{th}$ shift, $\alpha$ will be zero, and operation 633 will reduce to adding the $V_{th}$ shift amount to the efficiency-adjusted voltage 622. For any particular subpixel, the amount to add is constant until new measurements are taken. Therefore, in this case, the voltage to add in operation 633 can be pre-computed after measurements are taken, allowing blocks 63 and 64 to collapse to looking up the stored value and adding it. This can save considerable logic.

Cross-Domain Processing, and Bit Depth

Image-processing paths known in the art typically produce nonlinear code values (NLCVs), that is, digital values having a nonlinear relationship to luminance (Giorgianni & Madden. *Digital Color Management: encoding solutions*. Reading, Mass.: Addison-Wesley, 1998. Ch. 13, pp. 283-295). Using nonlinear outputs matches the input domain of a typical source driver, and matches the code value precision range to the human eye's precision range. However, $V_{th}$ shift is a voltage-domain operation, and thus is most easily implemented in a linear-voltage space. A linear source driver can be used, and domain conversion performed before the source driver, to effectively integrate a nonlinear-domain image-processing path with a linear-domain compensator. Note that while this discussion is in terms of digital processing, analogous processing could be performed in an analog or mixed digital/analog system. Note also that the compensator can operate in linear spaces other than voltage. For example, the compensator can operate in a linear current space.

Figure 7:
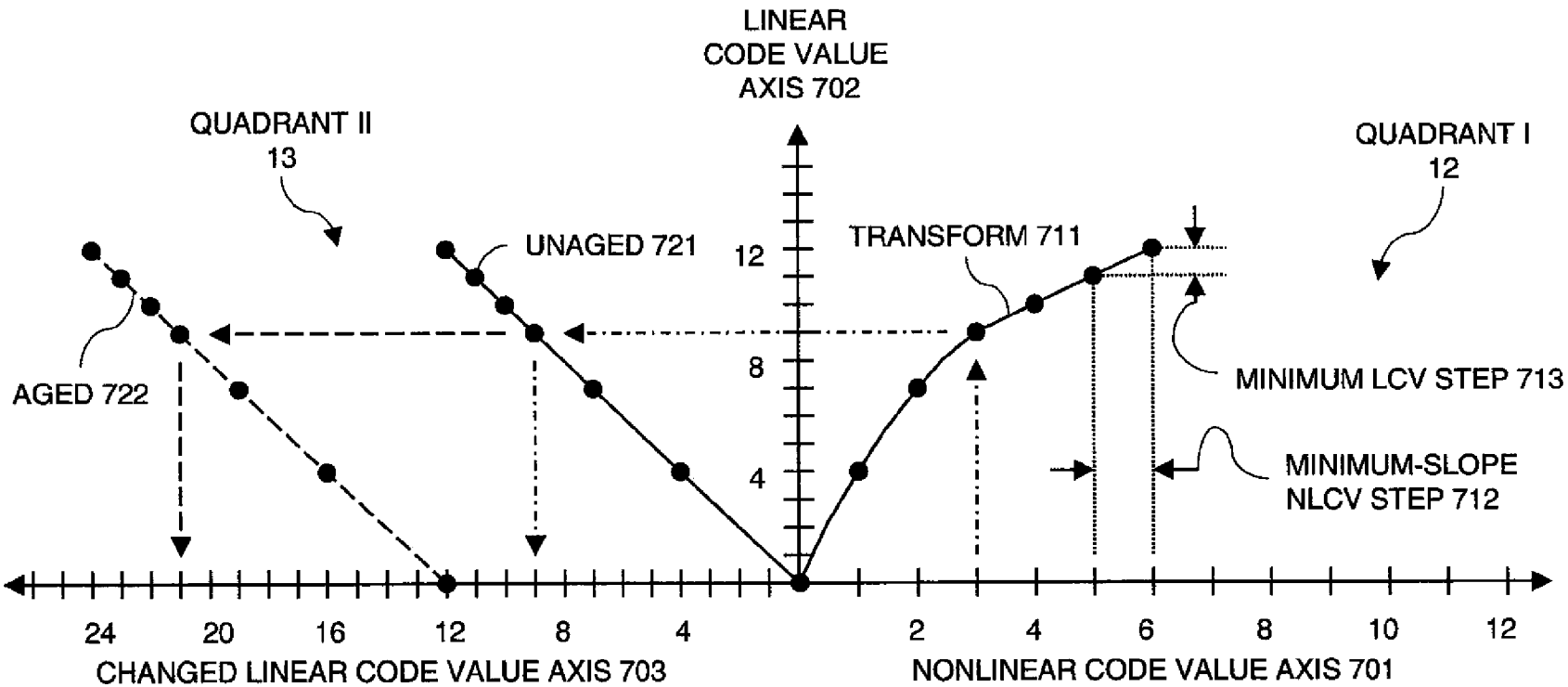
FIG. 7 is a Jones-diagram representation of the effect of a domain-conversion unit and a compensator.

Referring to FIG. 7, there is shown a Jones-diagram representation of the effect of a domain-conversion unit 12 and a compensator 13. This figure shows the mathematical effect of these units, not how they are implemented. The implementation of these units can be analog or digital. Quadrant I represents the operation of the domain-conversion unit 12: nonlinear input signals, which can be nonlinear code values (NLCVs), on axis 701 are converted by mapping them through transform 711 to form linear code values (LCVs) on axis 702. Quadrant II represents the operation of compensator 13: LCVs on axis 702 are mapped through transforms such as 721 and 722 to form changed linear code values (CLCVs) on axis 703.

Referring to Quadrant I, Domain-conversion unit 12 receives nonlinear input signals, e.g. NLCVs, and converts them to LCVs. This conversion should be performed with sufficient resolution to avoid objectionable visible artifacts such as contouring and crushed blacks. In digital systems, NLCV axis 701 can be quantized, as indicated on FIG. 7. In this case, LCV axis 702 should have sufficient resolution to represent the smallest change in transform 711 between two adjacent NLCVs. This is shown as NLCV step 712 and corresponding LCV step 713. As the LCVs are by definition linear, the resolution of the whole LCV axis 702 should be sufficient to represent step 713. Consequently, the LCVs can be defined with finer resolution than the NLCVs in order to avoid loss of image information. The resolution can be twice that of step 713 by analogy with the Nyquist sampling theorem.

Transform 711 is an ideal transform for an unaged subpixel. It has no relationship to aging of any subpixel or the panel as a whole. Specifically, transform 711 is not modified due to any $V_{th}$, $V_{oled}$, or OLED efficiency changes. There can be one transform for all colors, or one transform for each color. The domain-conversion unit, through transform 711, advantageously decouples the image-processing path from the compensator, allowing the two to operate together without having to share information. This simplifies the implementation of both.

Referring to Quadrant II, compensator 13 changes LCVs to changed linear code values (CLCVs) on a per-subpixel basis. FIG. 7 shows the simple case, correction for straight $V_{th}$ shift, without loss of generality. Straight $V_{th}$ shift can be corrected for by straight voltage shift from LCVs to CLCVs. Other aging effects can be handled as described above in "Implementation."

Curve 721 represents the compensator's behavior for an unaged subpixel. In this case, the CLCV can be the same as the LCV. Curve 722 represents the compensator's behavior for an aged subpixel. In this case, the CLCV can be the LCV plus an offset representing the $V_{th}$ shift of the subpixel in question. Consequently, the CLCVs will generally require a large range than the LCVs in order to provide headroom for compensation. For example, if a subpixel requires 256 LCVs when it is new, and the maximum shift over its lifetime is 128 LCVs, the CLCVs will need to be able to represent values up to 384=256+128 to avoid clipping the compensation of heavily-aged subpixels.

FIG. 7 shows a complete example of the effect of the domain-conversion unit and compensator. Following the dash-dot arrows on FIG. 7, an NLCV of 3 is transformed by the domain-conversion unit 12 through transform 711 to an LCV of 9, as indicated in Quadrant I. For an unaged subpixel, the compensator 13 will pass that through curve 721 as a CLCV of 9, as indicated in Quadrant II. For an aged subpixel with a $V_{th}$ shift analogous to 12 CLCVs, the LCV of 9 will be converted through curve 722 to a CLCV of 9+12=21.

In practice, the NLCVs can be code values from an image-processing path, and can have eight bits or more. There can be an NLCV for each subpixel on a panel, for each frame. The LCVs can be linear values representing voltages to be driven by a source driver, and can have more bits than the NLCVs in order to have sufficient resolution, as described above. The CLCVs can also be linear values representing voltages to be driven by the source driver. They can have more bits than the LCVs in order to provide headroom for compensation, also as described above. There can be an LCV and a CLCV for each subpixel, each produced from the input NLCV as described herein.

In one embodiment, the code values (NLCVs), or nonlinear input signals, from the image-processing path are nine bits wide. The linear code values, which can represent voltages, are 11 bits wide. The transformation from nonlinear input signals to linear code values can be performed by a LUT or function. The compensator can take in the 11-bit linear code value representing the desired voltage and produce a 12-bit changed linear code value to send to a linear source driver 14. The linear source driver can then drive the gate electrode of the drive transistor of an attached EL subpixel in response to the changed linear code value. The compensator can have greater bit depth on its output than its input to provide headroom for compensation, that is, to extend the voltage range 78 to voltage range 79 while keeping the same resolution across the new, expanded range, as required for minimum linear code value step 74. The compensator output range can extend below the range of curve 71 as well as above it.

Each panel design can be characterized to determine what the maximum $V_{th}$ shift 73, $V_{oled}$ rise and efficiency loss will be over the design life of a panel, and the compensator and source drivers can have enough range to compensate. This characterization can proceed from required current to required gate bias and transistor dimensions via the standard transistor saturation-region $I_{ds}$ equation, then to $V_{th}$ shift over time via various models known in the art for a-Si degradation over time.

Sequence of Operations

Panel Design Characterization

This section is written in the context of mass-production of a particular OLED panel design. Before mass-production begins, the design can be characterized: accelerated life testing can be performed, and I-V curves are measured for various subpixels of various colors on various sample panels aged to various levels. The number and type of measurements required, and of aging levels, depend on the characteristics of the particular panel. With these measurements, a value alpha ($\alpha$) can be calculated and a measurement reference gate voltage can be selected. Alpha (FIG. 6*c*, item 632) is a value representing the deviation from a straight shift over time. An $\alpha$ value of 0 indicates all aging is a straight shift on the voltage axis, as would be the case e.g. for $V_{th}$ shift alone. The measurement reference gate voltage (FIG. 5*a* 310) is the voltage at which aging signal measurements are taken for compensation, and can be selected to provide good S/N ratio while keeping power dissipation low.

The $\alpha$ value can be calculated by optimization. An example is given in Table 1. $\Delta V_{th}$ can be measured at a number of gate voltages, under a number of aging conditions. $\Delta V_{th}$ differences are then calculated between each $\Delta V_{th}$ and the $\Delta V_{th}$ at the measurement reference gate voltage 310. $V_g$ differences are calculated between each gate voltage and the measurement reference gate voltage 310. The inner term of Eq. 1, $\Delta V_{th} \cdot \alpha \cdot (V_{g,ref} - V_{in})$, can then be computed for each measurement to yield a predicted $\Delta V_{th}$ difference, using the appropriate $\Delta V_{th}$ at the measurement reference gate voltage 310 as $\Delta V_{th}$ in the equation, and using the appropriate calculated gate voltage difference as $(V_{g,ref} - V_{in})$. The $\alpha$ value can then be selected iteratively to reduce, and preferable mathematically minimize, the error between the predicted $\Delta V_{th}$ differences and the calculated $\Delta V_{th}$ differences. Error can be expressed as the maximum difference or the RMS difference. Alternative methods known in the art, such as least-squares fitting of $\Delta V_{th}$ difference as a function of $V_g$ difference, can also be used.

TABLE 1

Example of α calculation

| | $\Delta V_{th}$ | | $V_g$ | $\Delta V_{th}$ difference | | Predicted $\Delta V_{th}$ difference | | Error | |
|---|---|---|---|---|---|---|---|---|---|
| Vg | Day 1 | Day 8 | difference | Day 1 | Day 8 | Day 1 | Day 8 | Day 1 | Day 8 |
| ref = 13.35 | 0.96 | 2.07 | 0 | 0 | 0 | 0.00 | 0.00 | 0.00 | 0.00 |
| 12.54 | 1.05 | 2.17 | 0.81 | 0.09 | 0.1 | 0.04 | 0.08 | 0.05 | 0.02 |
| 11.72 | 1.1 | 2.23 | 1.63 | 0.14 | 0.16 | 0.08 | 0.17 | 0.06 | −0.01 |
| 10.06 | 1.2 | 2.32 | 3.29 | 0.24 | 0.25 | 0.16 | 0.33 | 0.08 | −0.08 |
| | | | $V_{g,ref} - V_{in}$ | | | α = 0.0491 | | max = 0.08 | |

In addition to α and the measurement reference gate voltage, characterization can also determine, as described above, $V_{oled}$ shift as a function of $V_{th}$ shift, efficiency loss as a function of $V_{th}$ shift, self-heating component per subpixel, maximum $V_{th}$ shift, $V_{oled}$ shift and efficiency loss, and resolution required in the nonlinear-to-linear transform and in the compensator. Resolution required can be characterized in conjunction with a panel calibration procedure such as co-pending commonly-assigned U.S. Ser. No. 11/734,934, "Calibrating RGBW Displays" by Alessi et al., dated Apr. 13, 2007, incorporated by reference herein. Characterization also determines, as will be described in "In the field," below, the conditions for taking characterization measurements in the field. All these determinations can be made by those skilled in the art.

Mass-Production

Once the design has been characterized, mass-production can begin. At manufacturing time, one or more I-V curves are measured for each panel produced. These panel curves can be averages of curves for multiple subpixels. There can be separate curves for different colors, or for different regions of the panel. Current can be measured at enough drive voltages to make a realistic I-V curve; any errors in the I-V curve can affect the results. Also at manufacturing time, the reference current, the current at the measurement reference gate voltage, can be measured for every subpixel on the panel. The I-V curves and reference currents are stored with the panel and it is sent into the field.

In the Field

Once in the field, the subpixels on the panel age at different rates depending on how hard they are driven. After some time one or more pixels have shifted far enough that they need to be compensated; how to determine that time is considered below.

To compensate, compensation measurements are taken and applied. The compensation measurements are of the current of each subpixel at the measurement reference gate voltage. The measurements are applied as described in "Algorithm," above. The measurements are stored so they can be applied whenever that subpixel is driven, until the next time measurements are taken. The entire panel or any subset thereof can be measured when taking compensation measurements; when driving any subpixel, the most recent measurements for that subpixel can be used in the compensation. This also means a first subset of the subpixels can be measured at one time and second subset at another time, allowing compensation across the panel even if not every subpixel has been measured in the most recent pass. Blocks larger than one subpixel can also be measured, and the same compensation applied to every subpixel in the block, but doing so requires care to avoid introducing block-boundary artifacts. Additionally, measuring blocks larger than one subpixel introduces vulnerability to visible burn-in of high spatial-frequency patterns; such patterns can have features smaller than the block size. This vulnerability can be traded off against the decreased time required to measure multiple-subpixel blocks compared to individual subpixels.

Figure 8:
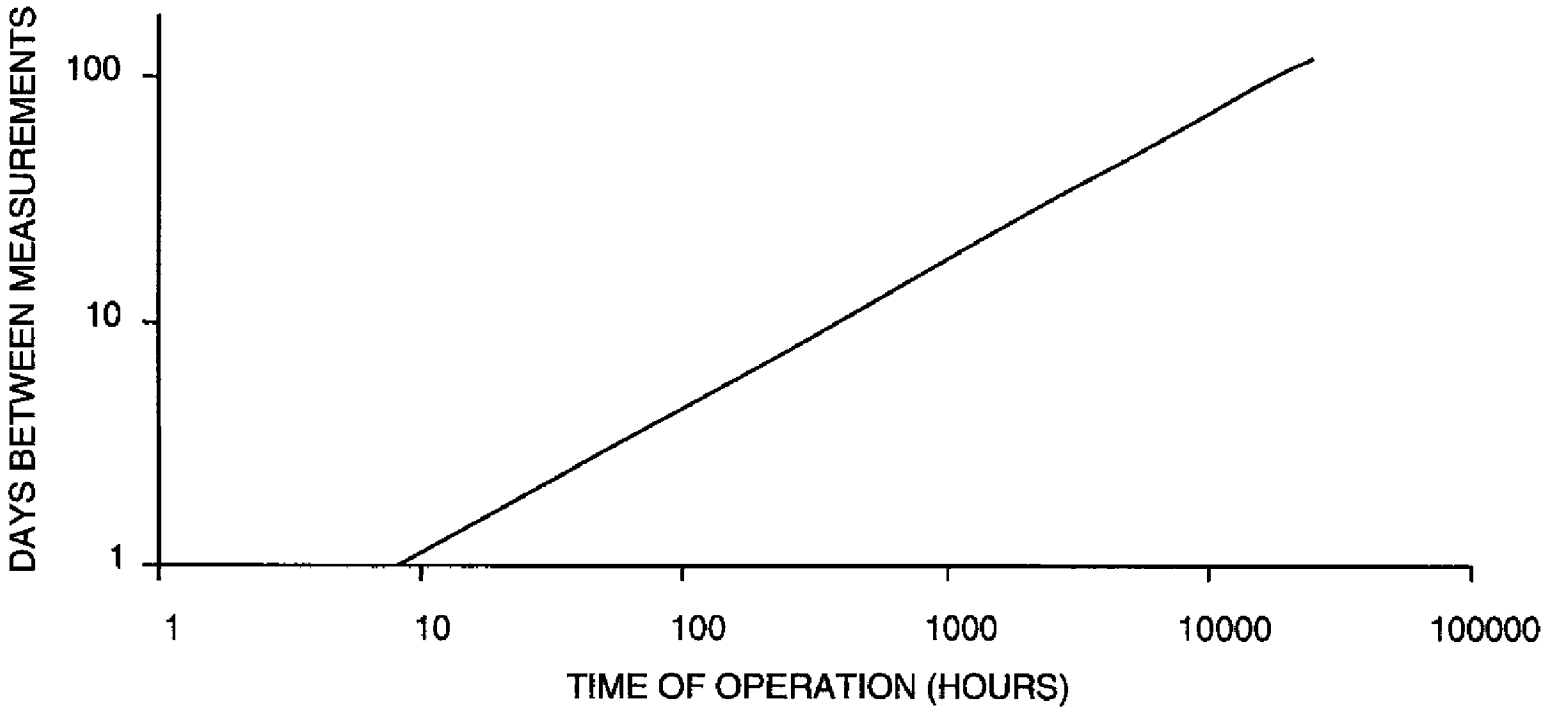
FIG. 8 is a representative plot showing frequency of compensation measurements over time.

Compensation measurements can be taken as frequently or infrequently as desired; a typical range can be once every eight hours to once every four weeks. FIG. 8 shows one example of how often compensation measurements might have to be taken as a function of how long the panel is active. This curve is only an example; in practice, this curve can be determined for any particular panel design through accelerated life testing of that design. The measurement frequency can be selected based on the rate of change in the characteristics of the drive transistor and EL device over time; both shift faster when the panel is new, so compensation measurements can be taken more frequently when the panel is new than when it is old. There are a number of ways to determine when to take compensation measurements. For example, the total current drawn by the entire panel active at some given drive voltage can be measured and compared to a previous result of the same measurement. In another example, environmental factors which affect the panel, such as temperature and ambient light, can be measured, and compensation measurements taken e.g. if the ambient temperature has changed more than some threshold. Alternatively, the current of individual subpixels can be measured, either in the image area of the panel or out. If outside the image area of the panel, the subpixels can be reference subpixels provided for measurement purposes. The subpixels can be exposed to whatever portion of the ambient conditions is desired. For example, subpixels can be covered with opaque material to cause them to respond to ambient temperature but not ambient light.

The invention has been described in detail with particular reference to certain preferred embodiments thereof, but it will be understood that variations and modifications can be effected within the spirit and scope of the invention. For example, the above embodiments are constructed wherein the transistors in the drive circuits are n-channel transistors. It will be understood by those skilled in the art that embodiments wherein the transistors are p-channel transistors, or some combination of n-channel and p-channel, with appropriate well-known modifications to the circuits, can also be useful in this invention. Additionally, the embodiments described show the OLED in a non-inverted (common-cathode) configuration; this invention also applies to inverted (common-anode) configurations. The above embodiments are further constructed wherein the transistors in the drive circuits are a-Si transistors. The above embodiments can apply to any active matrix backplane that is not stable as a function of time. For instance, transistors formed from organic semiconductor materials and zinc oxide are known to vary as a function of time and therefore this same approach can be applied to these transistors. Furthermore, as the present invention can compensate for EL device aging independently of transistor aging, this invention can also be applied to an active-matrix backplane with transistors that do not age, such as LTPS TETs. This invention also applies to EL devices other than OLEDs. Although the degradation modes of other EL device types can be different than the degradation modes described herein, the measurement, modeling, and compensation techniques of the present invention can still be applied.

| PARTS LIST | |
|---|---|
| 10 | overall system |
| 11 | nonlinear input signal |
| 12 | converter to voltage domain |
| 13 | compensator |
| 14 | linear source driver |
| 15 | OLED drive circuit |
| 16 | current-measurement circuit |
| 30 | OLED panel |
| 31 | source driver |
| 32a | column line |
| 32b | column line |
| 32c | column line |
| 33 | gate driver |
| 34a | row line |
| 34b | row line |
| 34c | row line |
| 35 | subpixel matrix |
| 36 | select transistor |
| 41 | measurement |
| 42 | measurement |
| 43 | difference |
| 49 | measurement |
| 60 | compensator |
| 61 | block |
| 62 | block |
| 63 | block |
| 64 | block |
| 71 | I-V curve |
| 73 | voltage shift |
| 74 | code value step |
| 75 | voltage step |
| 76 | voltage step |
| 78 | voltage range |
| 79 | voltage range |
| 90 | linear fit |
| 200 | switch |
| 201 | drive transistor |
| 202 | OLED device |
| 203 | gate electrode |
| 204 | first supply electrode |
| 205 | second supply electrode |
| 206 | voltage supply |
| 207 | first electrode |
| 208 | second electrode |
| 210 | current mirror unit |
| 211 | voltage supply |
| 212 | first current mirror |
| 213 | first current mirror output |
| 214 | second current mirror |
| 215 | bias supply |
| 216 | current-to-voltage converter |
| 220 | correlated double-sampling unit |
| 221 | sample-and-hold unit |
| 222 | sample-and-hold unit |

-continued

| PARTS LIST | |
|---|---|
| 223 | differential amplifier |
| 230 | analog-to-digital converter |
| 421 | self-heating amount |
| 422 | self-heating amount |
| 423 | measurement |
| 424 | difference |
| 501 | unaged I-V curve |
| 502 | aged I-V curve |
| 503 | voltage difference |
| 504 | voltage difference |
| 505 | voltage difference |
| 506 | voltage difference |
| 510 | measurement reference gate voltage |
| 511 | current |
| 512a | current |
| 512b | current |
| 513 | voltage |
| 514 | voltage shift |
| 550 | voltage shift |
| 552 | voltage shift |
| 601 | subpixel location |
| 602 | commanded voltage |
| 603 | compensated voltage |
| 611 | current |
| 612 | current |
| 613 | percent current |
| 614 | percent efficiency |
| 619 | memory |
| 621 | current |
| 622 | voltage |
| 626 | block |
| 628 | operation |
| 631 | voltage shift |
| 632 | alpha value |
| 633 | operation |
| 691 | I-V curve |
| 692 | inverse of I-V curve |
| 695 | model |
| 701 | axis |
| 702 | axis |
| 703 | axis |
| 711 | smallest change in transform |
| 712 | step |
| 713 | step |
| 721 | transform |
| 722 | transform |
| 1002 | storage capacitor |
| 1011 | bus line |
| 1012 | sheet cathode |

The invention claimed is:

1. Apparatus for providing an analog drive transistor control signal to the gate electrode of a drive transistor in a drive circuit that applies current to an EL device, the drive circuit including a voltage supply electrically connected to a first supply electrode of the drive transistor and the EL device electrically connected to a second supply electrode of the drive transistor, comprising:

a) a measuring circuit for measuring the current passing through the first and second supply electrodes at first and second times to provide respective aging signals representing variations in the characteristics of the drive transistor and EL device caused by operation of the drive transistor and EL device over time, the measuring circuit including a memory for storing the measured current at the first time;

b) means for providing a linear code value;

c) a compensator for changing the linear code value in response to the aging signal to compensate for the variations in the characteristics of the drive transistor and EL device, wherein the compensator is adapted to calculate current change from the aging signal values at the first and second times, map current loss to threshold voltage shift, and add the mapped threshold voltage shift to the linear code value to provide a changed linear code value; and d) a source driver having a linear relationship of input code value to analog voltage for producing the analog drive transistor control signal in response to the changed linear code value for driving the gate electrode of the drive transistor.

2. The apparatus of claim 1 wherein the EL device is an OLED device.

3. The apparatus of claim 1 wherein the drive transistor is an amorphous silicon transistor.

4. The apparatus of claim 1 further including a switch for selectively electrically connecting the measuring circuit to the current flow through the first and second supply electrodes.

5. The apparatus of claim 1 wherein the measuring circuit includes a first current mirror for producing a mirrored current which is a function of the drive current passing through the first and second supply electrodes and a second current mirror for applying a bias current to the first current mirror to reduce voltage variations in the first current mirror.

6. The apparatus of claim 5 wherein the measurement circuit further includes a current to voltage converter responsive to the mirrored current for producing a voltage signal and means responsive to the voltage signal for providing the aging signal to the compensator.

7. The apparatus of claim 1 further including means for receiving a nonlinear input signal and for converting the nonlinear input signal to the linear code value.

8. The apparatus of claim 7 wherein the converting means includes a look up table.

9. The apparatus of claim 1, wherein the compensator includes efficiency-compensation means and voltage-compensation means.

10. The apparatus of claim 1, wherein the compensator further includes a memory for storing a reference aging signal measurement and a most recent aging signal measurement.

11. The apparatus of claim 1, wherein the compensator is configured to perform both an efficiency compensation and a voltage compensation.

12. The apparatus of claim 11, wherein the voltage compensation includes compensating for both Vth shift and Voled rise.

* * * * *